US005453053A

United States Patent [19]

Danta et al.

[11] Patent Number: 5,453,053

[45] Date of Patent: Sep. 26, 1995

[54] AMUSEMENT RIDE HAVING SPINNING PASSENGER CARS

[75] Inventors: Randall C. Danta, Los Angeles; Michael G. Kilbert, Santa Clarita; Jody D. Gerstner, Huntington Beach; Francis K. Weigand, La Crescenta; Ted W. Fredrick, Saugus, all of Calif.

[73] Assignee: The Walt Disney Company, Burbank, Calif.

[21] Appl. No.: 92,199

[22] Filed: Jul. 15, 1993

[51] Int. Cl.[6] ..... A63G 1/10; A63G 1/24

[52] U.S. Cl. ..... 472/29; 472/36; 280/791

[58] Field of Search ..... 472/27, 29, 36, 472/37, 43, 40, 41; 104/74, 75, 53, 139; 280/748, 751, 753, 791; 180/89.1

[56] References Cited

U.S. PATENT DOCUMENTS

| | | | |
|---|---|---|---|
| 716,285 | 12/1902 | St. Clair . | |
| 717,798 | 1/1903 | Beerwald . | |
| 789,973 | 5/1905 | Hartung . | |
| 811,284 | 1/1906 | Gaynor . | |
| 825,130 | 7/1906 | Jurgens . | |
| 872,253 | 11/1907 | Riehl . | |
| 881,637 | 3/1908 | Van Sant . | |
| 886,627 | 5/1908 | Neebe . | |
| 888,881 | 5/1908 | Geores . | |
| 922,052 | 5/1909 | Sherk . | |
| 965,768 | 7/1910 | Van Sant . | |
| 1,133,623 | 3/1915 | Dreifuss . | |
| 1,399,577 | 12/1921 | Riehl . | |
| 1,404,143 | 1/1922 | Riehl . | |
| 1,447,605 | 3/1923 | Schafer | 280/791 |
| 1,597,491 | 8/1926 | Traver . | |
| 2,196,093 | 4/1940 | Bartlett . | |
| 3,082,699 | 3/1963 | Schmitz | 472/27 |
| 3,218,027 | 11/1965 | Richardson et al. . | |
| 3,393,010 | 7/1968 | Steinberg | 283/753 |
| 3,410,223 | 11/1968 | Miller | 104/139 |
| 3,554,538 | 1/1971 | Fullmer . | |
| 3,603,583 | 9/1971 | Bartlett | 472/40 |
| 3,791,308 | 2/1974 | Hartz . | |
| 4,246,848 | 1/1981 | Schneider . | |
| 4,347,791 | 9/1982 | Mandros . | |
| 4,440,091 | 4/1984 | Burgess . | |
| 4,507,993 | 4/1985 | Silverman et al. . | |
| 4,823,705 | 4/1989 | Fukuda . | |

FOREIGN PATENT DOCUMENTS

| | | |
|---|---|---|
| 840120 | 4/1937 | France . |

*Primary Examiner*—Carl D. Friedman
*Assistant Examiner*—Kien T. Nguyen
*Attorney, Agent, or Firm*—Pretty, Schroeder, Brueggemann & Clark

[57] ABSTRACT

An improved amusement ride and ride vehicle that permit a passenger to control the rotation of a passenger car as the vehicle travels along a ride course. The ride vehicle includes a support tube upon which the passenger car is rotatably mounted and a passenger operable steering mechanism. The ride vehicle also includes a spin shaft that extends down through the support tube. The spin shaft permits the use of safety systems that are mounted to the chassis of the ride vehicle. Control logic may be used to turn the passenger cars to a preferred orientation at the end of the ride. The ride vehicle itself may be barbell shaped to permit it to turn sharp corners along the ride course. The passenger car also includes a readily adjustable lap bar that is self-releasing. A slot cover, a plow assembly for displacing the slot cover and a slot cover switch are also provided.

56 Claims, 22 Drawing Sheets

46
14B
14B
12A
12A
12B
12B
454
454
472
478
462
464
474
476
470
460
478
464
484
476
474
482
470

AMUSEMENT RIDE HAVING SPINNING PASSENGER CARS

This invention relates to amusement rides and amusement ride vehicles and, in particular, to an amusement ride vehicle having one or more passenger cars that are spinable by a passenger as the vehicle travels along a ride course.

BACKGROUND OF THE INVENTION

Amusement parks and theme parks presently operate a variety of rides for the amusement and exhilaration of their patrons. One type of ride includes a number of individual passenger cars, each holding a relatively small number of passengers, that travel along a ride course. During the course of the ride, and depending on the type of ride, passengers can expect to encounter many startling and/or entertaining settings. Various special effects may be employed to recreate rain, fire, smoke, fog, explosions, illusions, etc. Animated characters may be used to add to the reality or fantasy of the environment.

Typically for such rides, the rotation of the passenger car, if any, and the direction the passenger car faces throughout the ride course are predetermined such that the passengers in one passenger car receive the same or similar experience as passengers in other passenger cars. In some situations, however, it may be desirable to permit the passenger to change the direction the passenger car faces or to even spin the passenger car as it travels through the varied settings of the ride course. Most amusement rides do not permit this.

In view of the above, it should be appreciated that there is a need for an amusement ride that safely permits the passengers to control the direction the passenger car faces as the passenger car travels along the ride course and to control the speed at which the passenger car turns from one direction to another. Such a ride would significantly add to the excitement of the ride experience because the passengers would have a direct influence on the manner in which the various settings along the course are encountered and would also add a dimension of uncertainty as the passengers are free to experiment with various speeds and abrupt changes of direction at any selected location along the ride course.

For rides having passenger cars with spinning capability, whether passenger operable or not, it is often desirable that the passenger cars be placed in a preferred orientation (i.e., an "indexed position") at the completion of the ride to permit the passengers to easily disembark at an unloading station. There is, therefore, a need for an indexing mechanism that will stop the passenger car from spinning and turn it from any of its varied positions to the preferred indexed position. Such an indexing mechanism should also turn the passenger car to the indexed position as quickly as possible, yet not subject the passengers to too fast a turn.

Lap bars are a desired safety feature for passenger cars that spin or that are subjected to relatively high speeds or rapid acceleration or deceleration along the ride course. Lap bars, however, are often uncomfortable to the passengers, are not readily adjustable and require the ride operator's attention to lock them in place or to release them. Accordingly, there is a need for an improved lap bar that is self-acting and easily adjustable.

In many amusement rides, the passenger car is supported above a show floor by a support shaft that is mounted to a chassis that travels along the ride course. In such instances, a slot is required through the show floor for passage of the support shaft. A problem with the slot, however, is that it presents a trip hazard for patrons. Accordingly, there is a need for a device to cover the slot, which is strong enough to support a person, yet able to be readily moved out of the way as the support shaft travels through the slot.

It is also desirable that, during the course of the amusement ride, the passenger car and/or the chassis supporting the passenger car be capable of turning sharp corners. In a typical straight-sided chassis, however, the "chordal effect" requires additional clearance envelope on the inside of each curve. This results in less design freedom in laying out the ride course and, in the case of a show floor having a slot for the passenger cars, requires a fortified cantilever structure for supporting the show floor. Therefore, there is also a need for a chassis design that defines a smaller clearance envelope.

The present invention satisfies the above needs.

SUMMARY OF THE INVENTION

The present invention is embodied in an amusement ride system that permits a passenger to control the direction a passenger car faces as it travels along a ride course and/or to spin the passenger car through multiple complete revolutions during the ride. The present invention includes a number of safety mechanisms for, among other things, controlling the speed of rotation of the passenger car, preventing rotation of the passenger car, and indexing the passenger car as it approaches an unloading station. The present invention also includes a number of features along the ride course, such as sensor targets to activate the safety mechanisms and barriers for protecting guests from trip hazards as they embark or disembark the passenger cars.

The amusement ride system of the present invention includes a chassis that operably engages a track along the ride course, a support tube or shaft fixed to the chassis, a passenger car rotatably mounted to the upper end of the support tube to permit spinning of the passenger car relative to the support tube, and a passenger operable steering mechanism for controlling the speed and direction of spin of the passenger car. In the preferred embodiment, the steering mechanism includes a passenger operable steering wheel, a pinion pulley rotatably mounted to the passenger car, a fixed pulley mounted to the upper end of the support tube, a belt operably engaging the pinion pulley and the fixed pulley, and a shaft between the steering wheel and the pinion pulley causing the pinion pulley to rotate upon rotation of the steering wheel. When torque is applied to the steering wheel by a passenger, the pinion pulley rotates the belt against the fixed pulley, resulting in the passenger car turning with respect to the chassis. This allows the passenger to choose the direction the passenger car faces, or to spin in either direction while traveling along the ride course.

One feature of the present invention is that the direction of spin of the passenger car can be made the same as the direction of steering. One way of accomplishing this is by using a two-sided toothed belt that contacts the pinion pulley on the side nearest the fixed pulley. Contact pressure is caused by two idler pulleys. The advantage of this technique is that the passenger car is "right steering." If the belt had been simply looped around the pinion and fixed pulleys, then turning the steering wheel to the right would cause the passenger car to rotate to the left. In the present implementation, a right turn of the wheel causes a right turn of the passenger car, resembling an automobile steering system.

The present invention may also incorporate a spin shaft that is fixed to the rotating passenger car and extends vertically down through the length of the support tube. The lower end of the spin shaft may be located by a self-aligning bearing. A feature of this embodiment is that the spin shaft is isolated from side loads or end loads, and only is acted on by torsion. Thus, side loads in the rotating passenger car may cause the support tube to flex, but this flexure does not get transmitted to the spin shaft. Another feature of this embodiment is that the rotation of the passenger car is transmitted to the chassis for use by a spin shaft drive assembly, a spin brake assembly, indexing systems, and/or electrical power transmission systems.

The present invention may also incorporate an indexing mechanism that operates in conjunction with a spin brake to stop the spin of the passenger car and turn it to a "forward facing" direction. A feature of this embodiment is that it uses simple relay logic to determine which direction requires the shortest turn. In a preferred embodiment, an indexing position detector is composed of a cam attached to the spin shaft and two proximity sensors. If, for example, the first sensor is blocked by the cam, an indexing motor is engaged in a clockwise direction. If the first sensor is not blocked, the indexing motor is engaged in a counterclockwise direction. If both sensors are blocked, the indexing motor is shut down, a clutch is disengaged, and the spin brake is engaged, i.e., the passenger car is indexed. An advantage of this embodiment is that passengers are subjected to a gradual spin when the passenger car is turned to the forward facing direction. Another advantage is that the relay logic is direct acting and may be easily adjusted in the event it is desired to adjust the final indexing position of the passenger car.

The present invention is especially adapted for use as an electrically-powered ride system wherein the chassis travels along a track that is concealed below a show floor. The passenger car is mounted on the support tube above the show floor as the support tube travels in an endless slot through the show floor. Because it is necessary for the passengers to walk upon the show floor to embark or disembark the passenger car, the present invention is also embodied in a barrier to prevent guests from tripping on the slot. In the preferred embodiment, the barrier is a slot cover that includes a rigid support bracket mounted on each side of the slot. The support brackets have tubular portions that extend into the slot. Resilient covers are mounted on the support brackets and have distal portions that extend even further into the slot such that the covers are in opposed relationship at the center of the slot. A plow which may be made of rollers is mounted to the support tube of the ride vehicle for individually lifting the resilient covers out of the way as the support tube travels through the slot.

An advantage of the slot cover design is that it allows the amusement ride system to be designed with a sub-floor track without presenting the danger of an open slot to guests and maintenance personnel. The slot cover is also strong enough to support a person, yet able to be moved out of the way as the passenger car passes by and is durable enough to survive a reasonable lifetime, has a relatively low replacement cost, generates little or no noise and requires little maintenance. Further, it presents a flat floor so that the guests are not distracted by the slot.

Another feature of the present invention is a lap bar assembly including a hydraulic actuator having a depressible pin valve. A lap bar is mounted to the passenger car and is connected to the hydraulic actuator such that it is permitted to move between a raised position and a lowered position when the pin valve is depressed. A mechanism is provided for automatically depressing the pin valve when the lap bar is pulled down and for automatically releasing the pin valve when the lap bar is pushed up. A lap bar release assembly is also provided and may be actuated by a raised portion of the show floor as the passenger car travels along the ride course.

The amusement ride system of the present invention may also incorporate dual passenger cars wherein the chassis has a barbell shape with circular ends roughly matching the diameter of the passenger cars. Each passenger car may be centered over its respective circular end of the chassis. Between the circular ends is a narrower connecting bridge. An advantage of this design is that it allows the relatively long chassis to turn sharp corners. In effect, each of the circular ends defines the chassis clearance envelope. In a normal straight-sided chassis, the "chordal effect" requires additional clearance envelope on the inside of each curve. This is because the straight-side of the chassis shortcuts the corner whenever the passenger car is in a curve. The barbell-shaped chassis of the present invention avoids this problem, allowing the chassis clearance below the show floor to match the clearance of the passenger car above the show floor. This is important, in part, because it allows the cantilever structure which supports the show floor and the slot cover to have constant length and physical properties.

Other features and advantages of the present invention will become apparent from the following description of the preferred embodiments, taken in conjunction with the accompanying drawings, which illustrate, by way of example, the principles of the invention.

DETAILED DESCRIPTION OF THE PREFERRED EMBODIMENT

Figure 1:
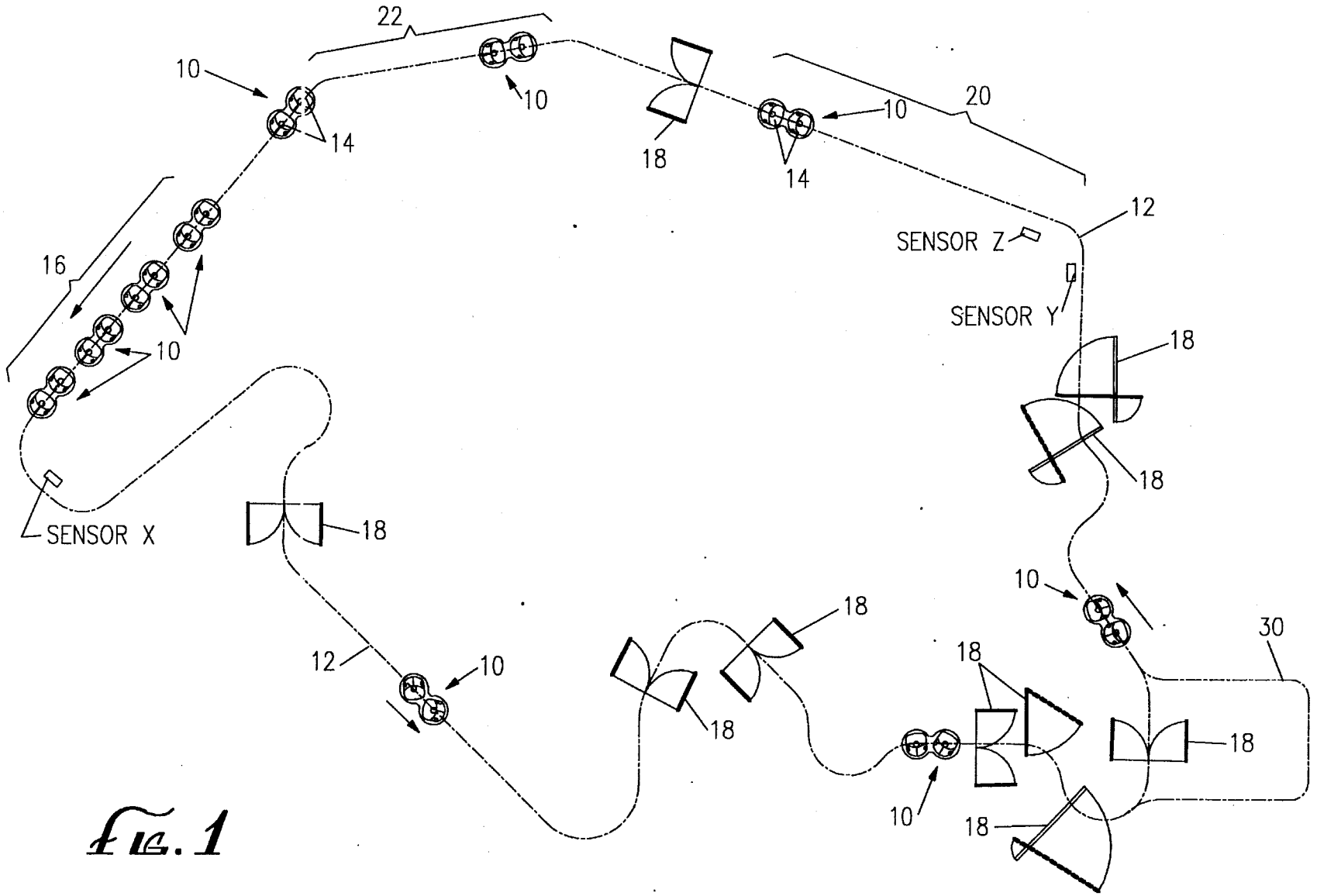
FIG. 1 is a plan view of an amusement ride system embodying the present invention, including a plurality of ride vehicles on a ride course.
Figure 3:
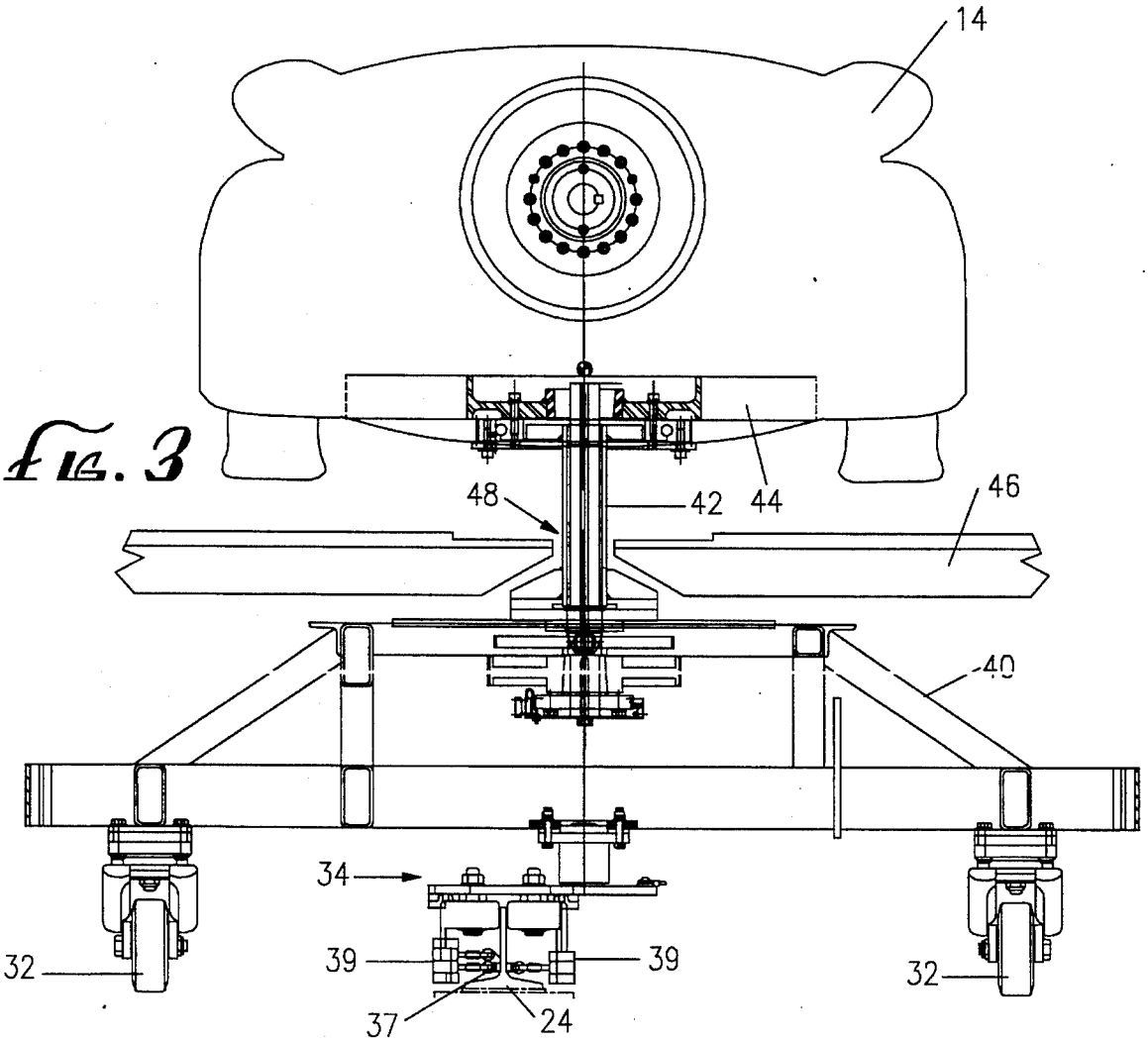
FIG. 3 is a rear view, partially in section, of the ride vehicle shown in FIG.2 taken along line 3–3.
Figure 2:
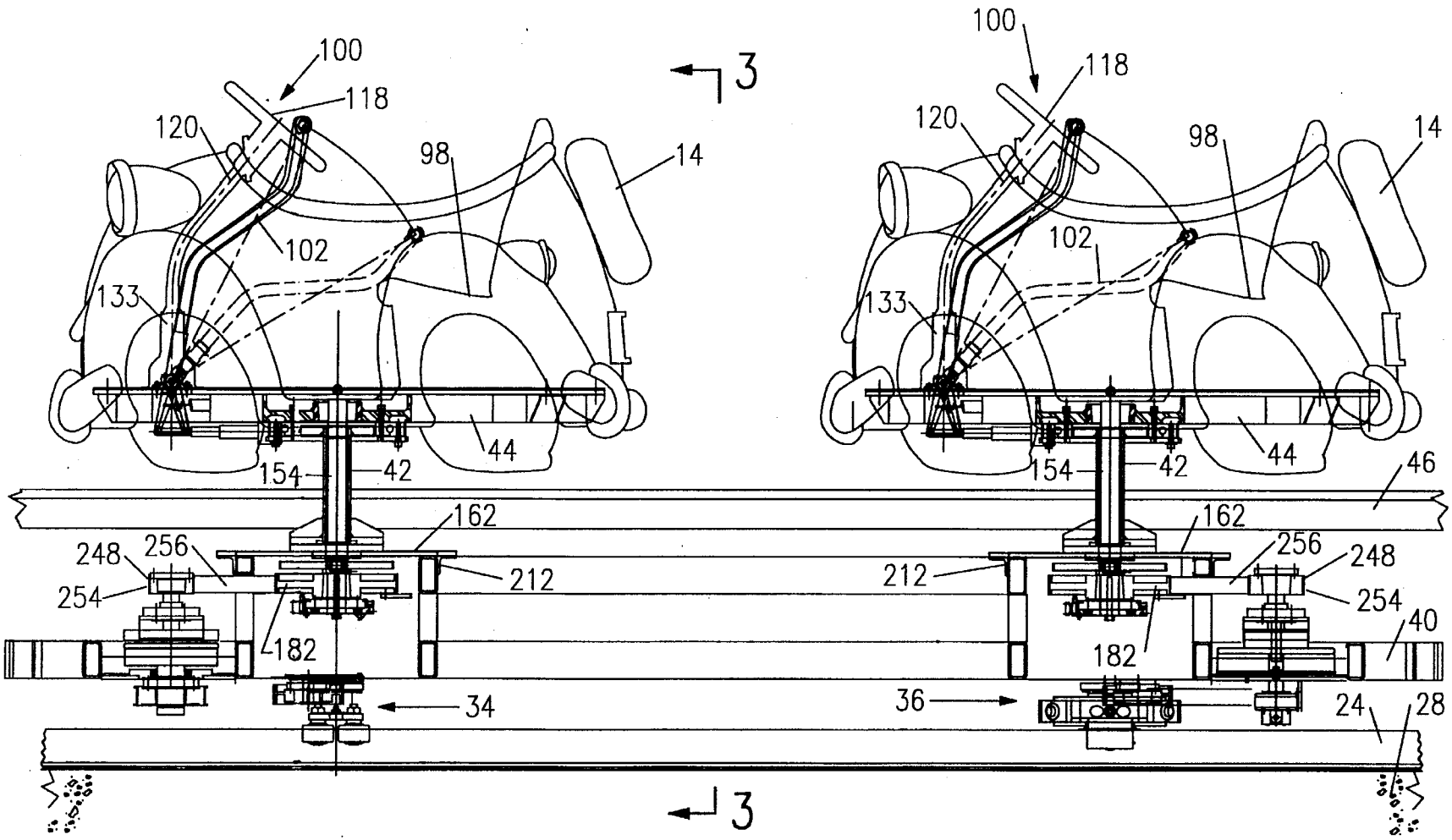
FIG. 2 is a side view partially in section, of a preferred embodiment of the ride vehicle.

An amusement ride embodying the features of the present invention is shown in FIGS. 1–3. In a preferred embodiment, the amusement ride is electrically powered and includes a plurality of individual ride vehicles 10 that travel along a ride course 12. Each ride vehicle may consist of two passenger cars 14 that each may hold one or more passengers.

Typically, in a "dark" ride, most of the ride course is laid out within a fully enclosed building (not shown), with only the various settings along the course being illuminated and/or animated as desired. A loading station 16 at the start of the ride course is located in a portion of the building that is adequately illuminated so that passengers may safely enter the passenger cars. Crash doors 18 may be placed along the ride course to transition between the illuminated loading station and the "dark" portion of the ride and to transition from one setting to the next. Preferably, the doors have no monitors and nothing to control. They are simply pushed open by the vehicles. Near the end of the ride is an indexing station 20 that may be used to place the passenger cars 14 in a "forward facing" position or other desired position that provides for easier and safer disembarkment from the vehicle at the conclusion of the ride. An unloading station 22 is provided at the end of the ride course to permit passengers to disembark the passenger cars and leave the building.

Figure 1A:
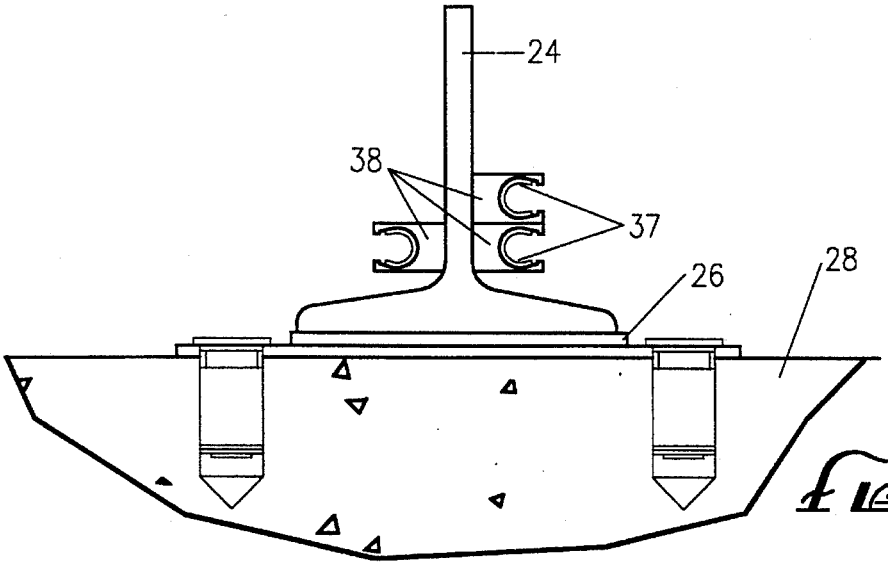
FIG. 1A is a sectional view of a preferred embodiment of a track laid along the ride course.

The vehicle 10 may travel along the ride course by means of a track 24 (see FIG. 1A). In the preferred embodiment, the track is a steel inverted "T" beam that is anchored to a track mounting pad 26 on a concrete foundation 28. The track 24 may include a maintenance spur 30 (see FIG. 1) that is accessed via track switches (not shown). The maintenance spur may be used for vehicle repair.

Figure 10A:
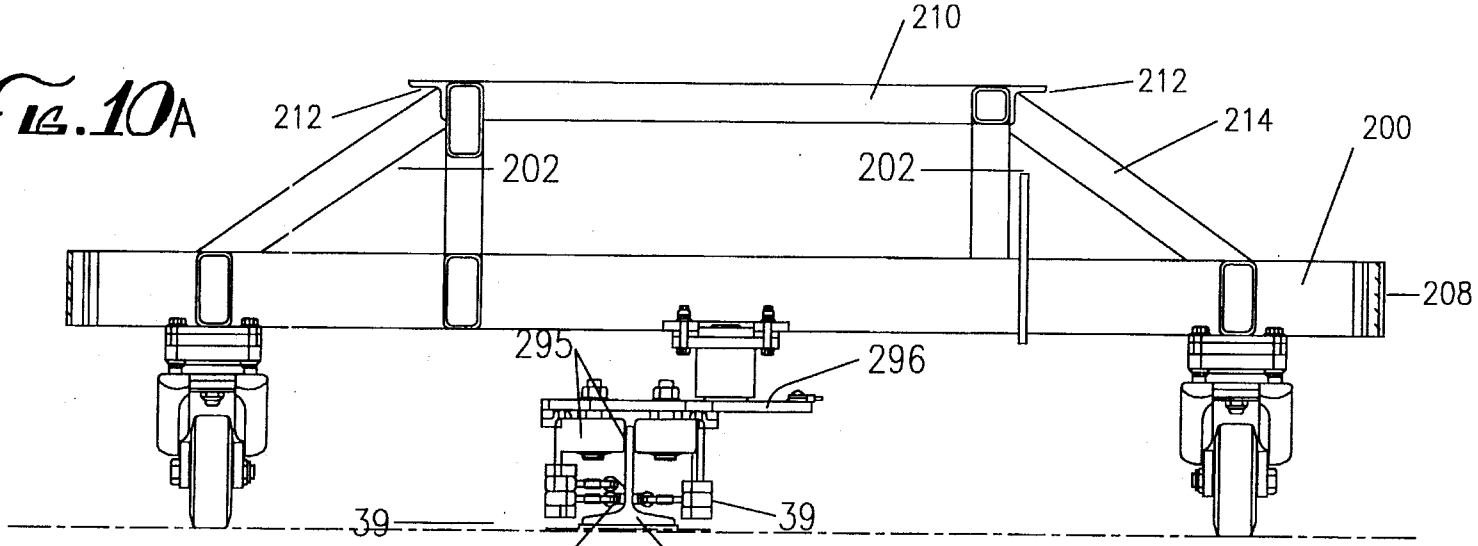
FIG. 10A is a sectional view of the chassis shown in FIG. 9 taken along line 10A—10A, with the upper frame included.
Figure 10B:
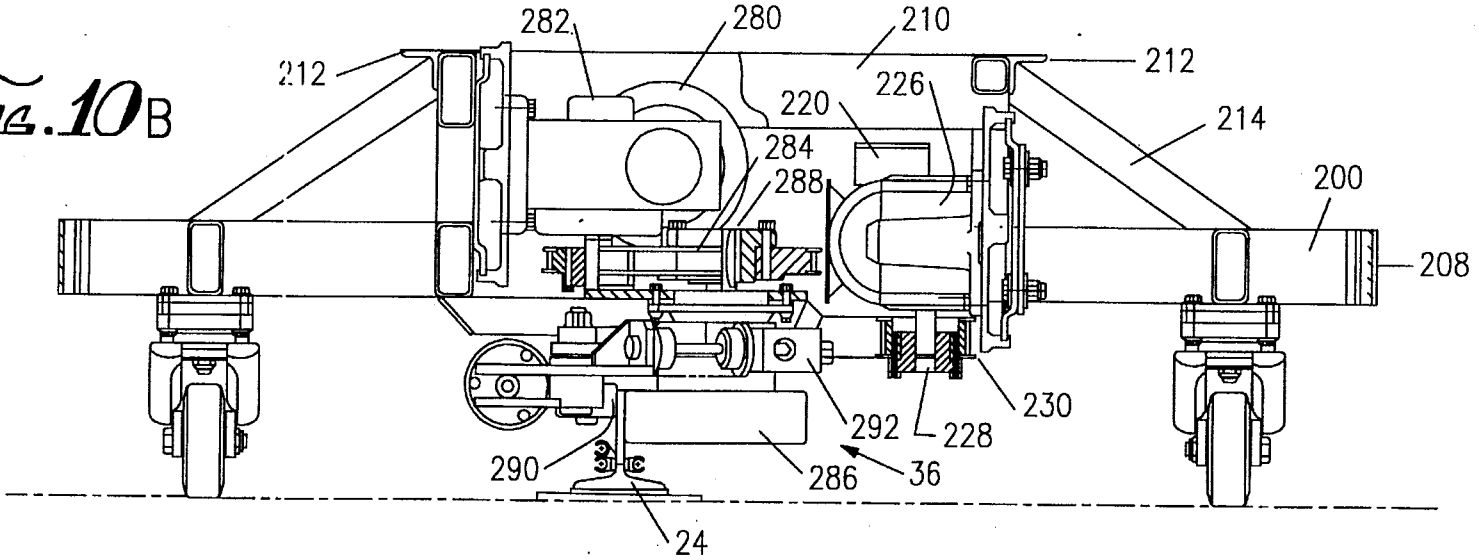
FIG. 10B is a sectional view of the chassis shown in FIG. 9 taken along line 10B—10B, with the upper frame included.

In the preferred embodiment, the vehicle has four wheels 32 and is guided and driven along the track by a guide bogey assembly 34 and a pinch roller drive mechanism 36, as will be described in greater detail below in connection with FIGS. 10A and 10B, respectively. Electrical power, preferably three phase 240 volt ac, may be supplied to the track through three bus-bars 37 that are mounted by means of hanging clamps 38 along each side of the track. The guide bogey assembly of each vehicle has collector shoes 39 that travel along and in contact with the bus-bars and collect power for the vehicle. It should be appreciated that the present invention is not limited to the above-described methods for guiding the vehicle along the ride course and for supplying power to drive the vehicle, but that there are many other known and available ways of guiding and powering such vehicles, electrically or otherwise.

In the preferred embodiment, the component parts of the vehicle include a longitudinally extending chassis 40, two support shafts or tubes 42 and two upper frames 44 (FIGS. 2 and 3). The chassis includes, among other things, the guide bogey assembly 34 and the pinch roller drive assembly 36 for engaging the track and for propelling the vehicle along the ride course, respectively. The support tubes are fixed to and extend upwardly from the chassis. The upper frames are rotatably mounted to upper ends of the support tubes and are spaced apart from each other in a longitudinal direction. The upper frames are also spaced apart from the chassis in a vertical direction. The two passenger cars 14, preferably made of fiberglass, are fixedly mounted onto the upper frames 44, respectively. Each passenger car includes a seat 98, a steering mechanism 100 that is operable by at least one of the passengers sitting in the seat, and a lap bar 102 that moves from an open position (shown in solid lines), allowing passengers to enter the passenger car, to a closed position (shown in dashed lines) that prevents them from leaving the passenger car during the ride.

The chassis and track may be concealed below a false floor or show floor 46 which forms a physical barrier between the guests and the bus-bars 37 on the track 24. The show floor defines an endless slot 48 through which the support tubes 42 travel during movement of the vehicle. Slot covers 50 (see FIG. 12) may be provided over the slots to protect guests from tripping on the slot. The slot covers will be described in more detail below. An added advantage of the show floor is that it provides the illusion that the passenger cars are actually driving on the show floor as they travel along the ride course.

Figure 4:
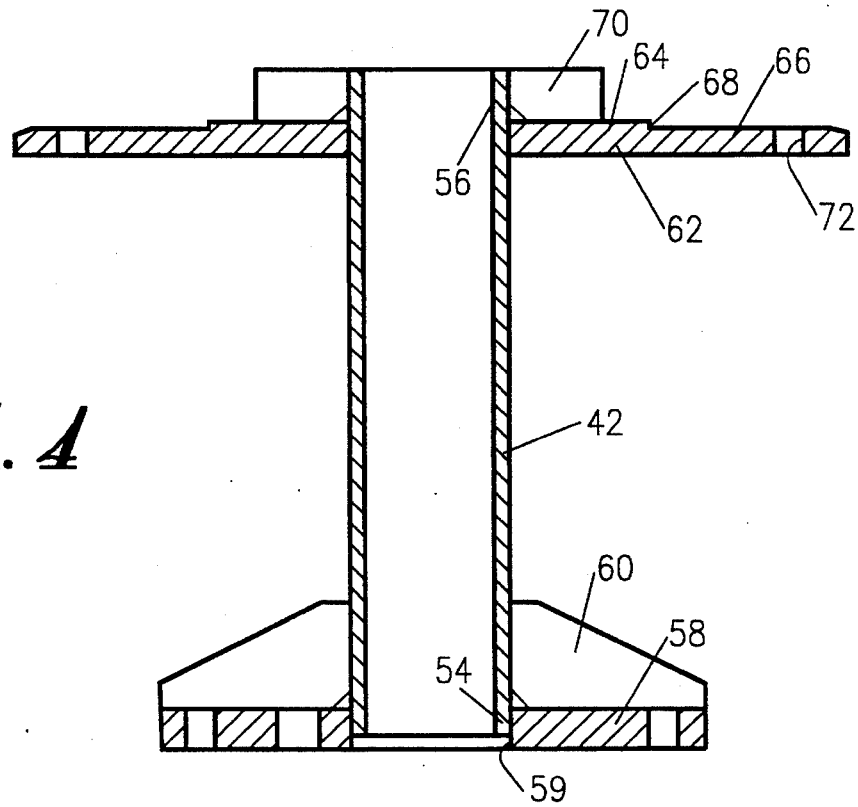
FIG. 4 is a sectional view of a support tube for the preferred embodiment of the ride vehicle.
Figure 6B:
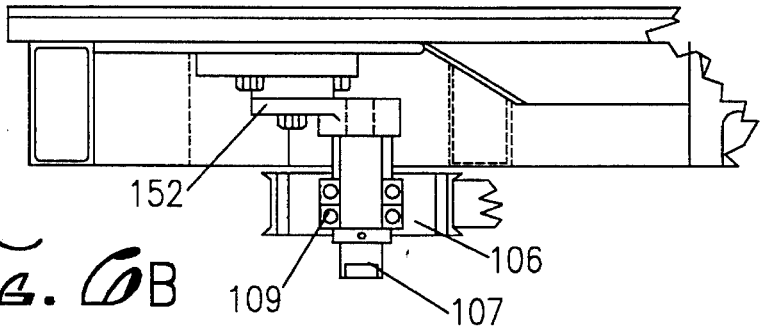
FIG. 6B is a sectional view of the upper frame shown in FIG. 6 taken along line 6B–6B.
Figure 6C:
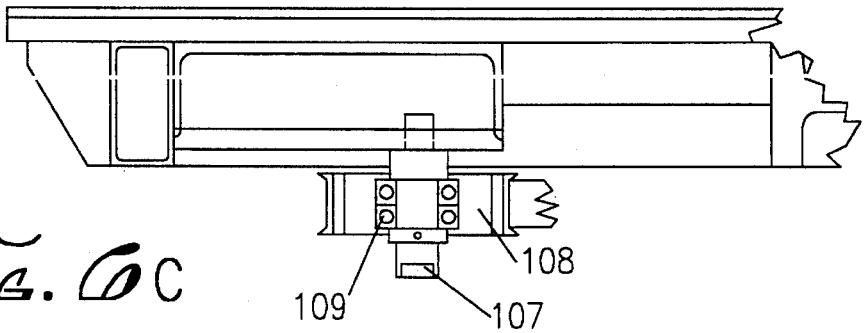
FIG. 6C is a sectional side view of the upper frame in FIGS. 6 taken along line 6C—6C.
Figure 5:
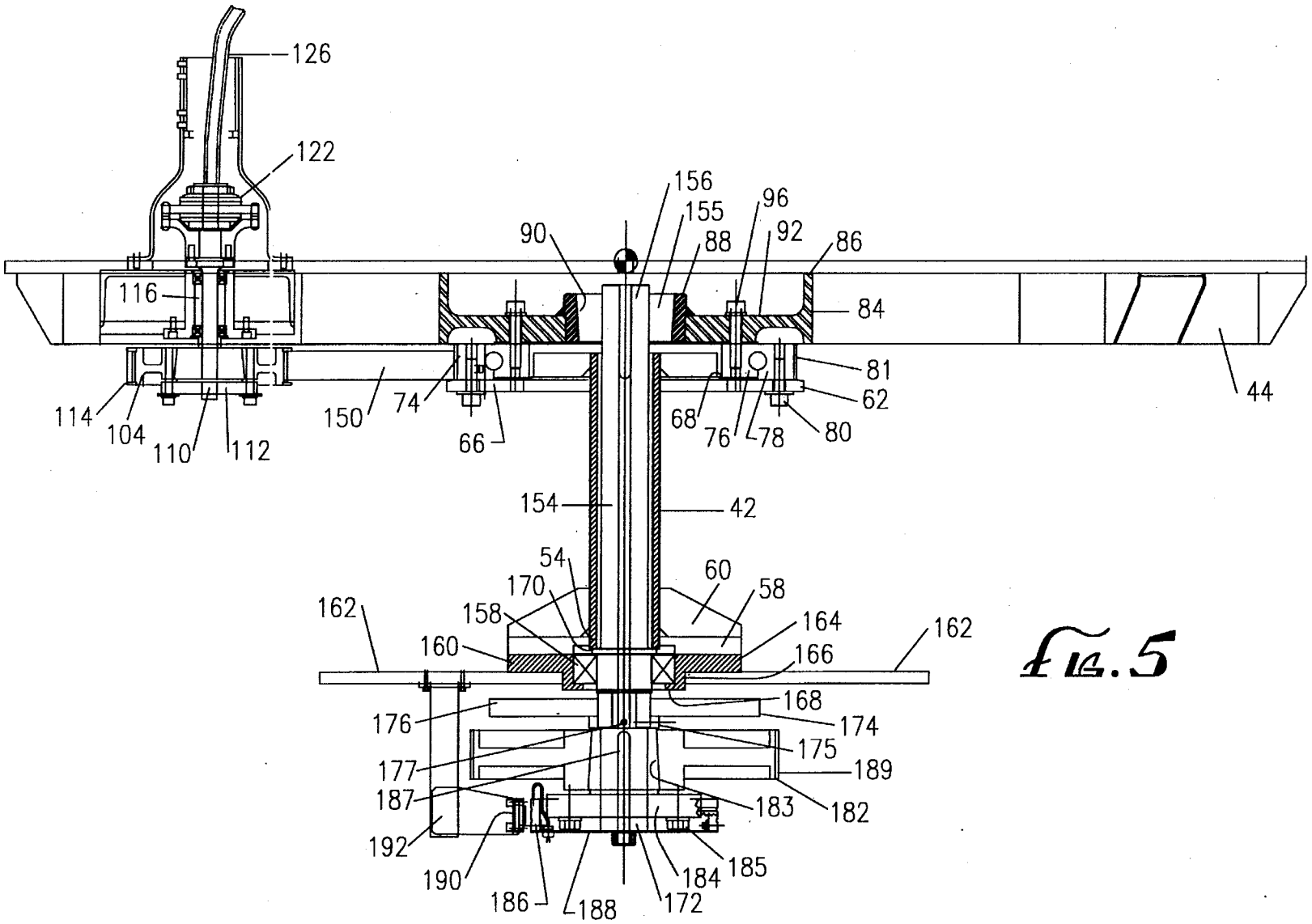
FIG. 5 is a side sectional view of the support tube, an upper frame, a spin shaft and a steering mechanism for the preferred embodiment of the ride vehicle.
Figure 6:
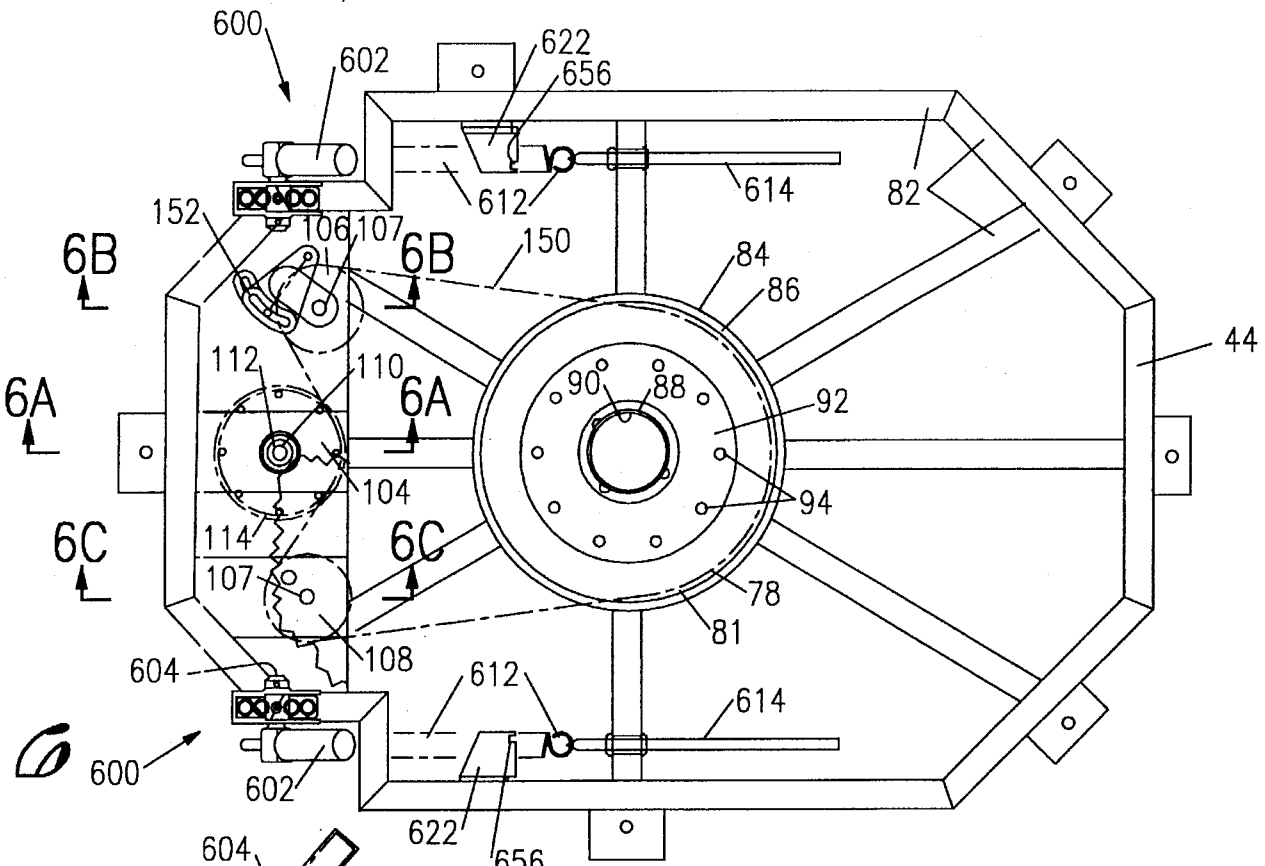
FIG. 6 is a plan view, partially in section, of the upper frame for the preferred embodiment of the ride vehicle.

With particular reference now to FIGS. 4–6, the construction of the support tubes 42 and upper frames 44 will be described. Each of the two support tube/upper frame combinations is identical to the other. Therefore, only one will be described in detail.

The support tube 42 includes a lower end 54 and an upper end 56 (FIG. 4). A base plate 58 having an opening 59 therethrough is welded to the lower end of the support tube. The support tube is centered over the opening 59. A plurality of gusset plates 60 may be welded between the base plate and the support tube at intervals around the periphery of the support tube to strengthen the connection.

A bearing support plate 62 is welded adjacent to the upper end 56 of the support tube. The bearing support plate has an inner annular portion 64 and an outer annular portion 66 separated by a shoulder portion 68. Gusset plates 70 are welded between the upper end of the support tube and the inner annular portion of the bearing support plate. The outer annular portion defines a plurality of circularly arranged holes 72 for receiving fasteners.

A large diameter, turntable ring bearing 74 is mounted on the outer annular portion 66 of the bearing support plate 62 (FIG. 5). The turntable ring bearing has an inner race 76, an outer race 78 and teeth 81 formed around the periphery of the outer race. The outer race is affixed to the bearing support plate by fasteners 80. It will be appreciated that the inner race is free to rotate and is located by the shoulder portion 68 of the bearing support plate. Turntable ring bearings are known in connection with their application to crane mountings, radar mountings and telescopes. A suitable turntable ring bearing should be rated to support the weight of the upper frame when fully loaded.

With reference now also to FIG. 6, the upper frame 44 is made of a suitable material, such as tubular steel beams 82, and constructed to support the weight of a fully loaded passenger car and the various steering and safety assemblies associated therewith. The peripheral shape of the upper frame is such that it is located within the outer periphery of the passenger car and therefore substantially hidden from the view of guests and passengers (see FIGS. 2 and 3).

The upper frame includes a centrally located mounting ring 84 having an outer peripheral flange 86, an inner hub 88 that defines an opening 90 therethrough and an annular reinforced plate portion 92 between the outer flange and the inner hub that defines a plurality of circularly arranged holes 94. The tubular steel beams 82 may all be tied into the outer peripheral flange by welding, for example. The mounting ring is affixed to the inner race 76 of the turntable ring bearing by fasteners 96. The passenger car 14 may be mounted to the frame by any suitable means, it being appreciated that the upper frame and passenger car are able to rotate on the turntable ring bearing relative to the support tube and chassis.

Mounted to the upper frame 44 are a pinion pulley 104, and first and second idler pulleys 106, 108, respectively. The pinion pulley is fixedly mounted to a drive shaft 110 through a bushing 112 and has a plurality of teeth 114 around its outer periphery (see FIG. 6A). A bearing set 116 mounted to the upper frame locates the drive shaft and pinion pulley, with the pinion pulley located just below the upper frame and vertically aligned with the turntable ring bearing 74. As will be described in greater detail below, the drive shaft of the pinion pulley is operably connected to the steering mechanism of the passenger cars.

The idler pulleys are rotatably mounted to idler shafts 107 through respective bearing sets 109 (see FIGS. 6B and 6C). The idler pulleys are located on either side of the pinion pulley and vertically aligned with the pinion pulley.

Figure 6D:
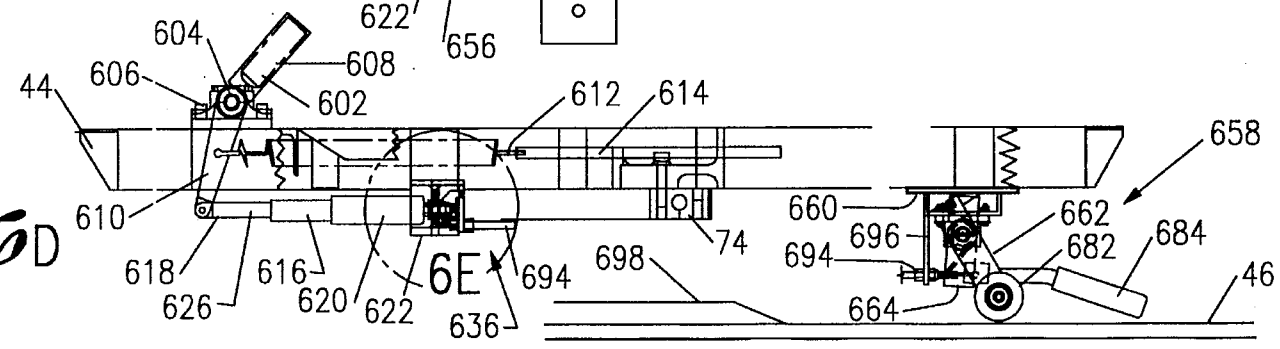
FIG. 6D is an elevational view, partially in section of the upper frame shown in FIG. 6, showing a lap bar assembly.
Figure 6E:
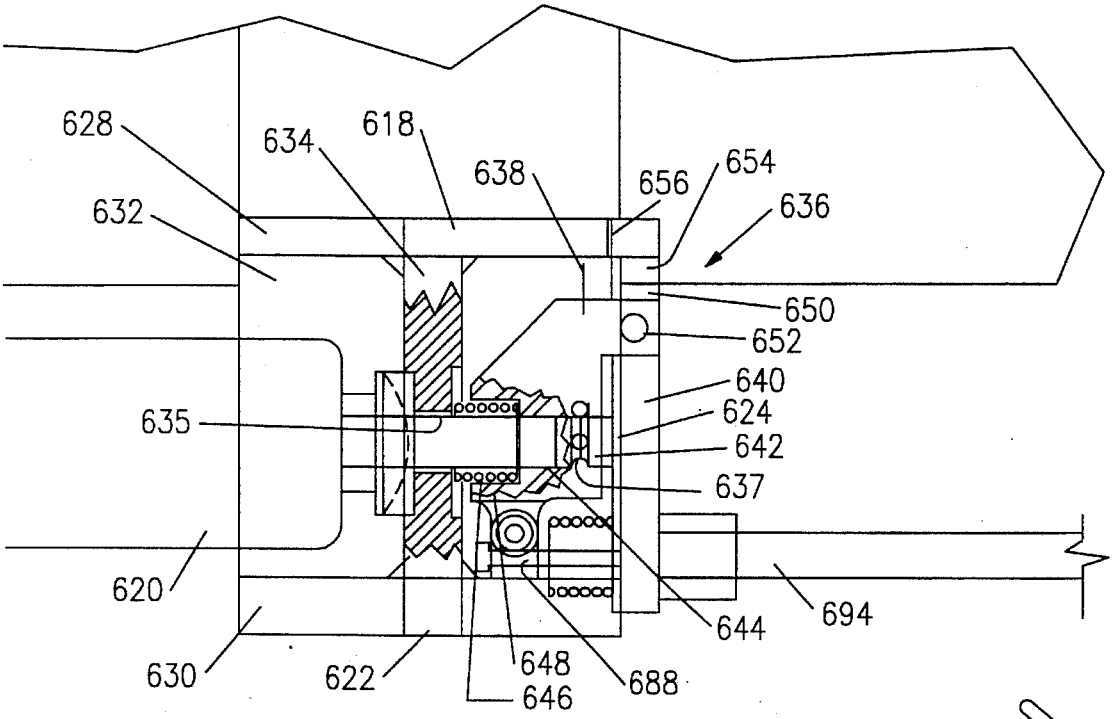
FIG. 6E is an enlarged view of a portion of the lap bar assembly, designated as detail 6E in FIG. 6.
Figure 6A:
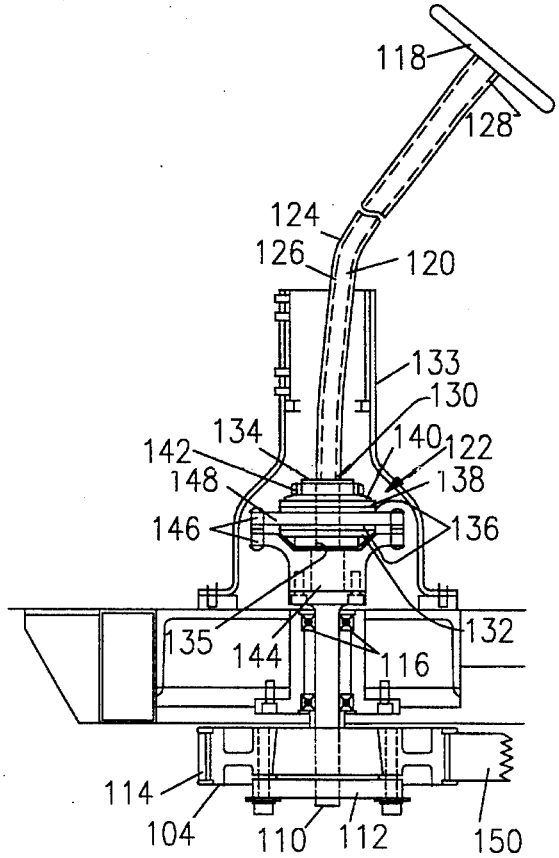
FIG. 6A is an enlarged sectional view of the steering mechanism shown in FIG. 5, taken along line 6A—6A in FIG. 6.

In the preferred embodiment, the steering mechanism 100 includes a steering wheel 118, a flexible shaft 120, a slip clutch 122 and the drive shaft 110 (see FIGS. 2 and 6A). The flexible shaft includes a fixed outer sheathing 124 and a rotatable inner coiled core 126 that transmits the torque load applied by a passenger on the steering wheel through the slip clutch to the drive shaft. Flexible shafts are well known in connection with their application to steering systems, power transmission systems and remote control systems.

In the preferred embodiment, a first end 128 of the coiled core 126 of the flexible shaft is fixed to the steering wheel. A second end 130 of the coiled core may be fastened to the slip clutch. The slip clutch 122, or other type of torque limiter, disengages the steering wheel when the torque applied to the steering wheel is above a predetermined level. Steering should preferably be disabled when a brake is applied to stop the passenger car from spinning, when the passenger car is being indexed or when a passenger forcibly reverses the rotation of the steering wheel faster than the passenger car can respond. In these situations, even though the steering wheel may be operated, it will not cause further operator induced spinning of the passenger car because the steering wheel torque is limited to that supplied by the slip clutch.

The slip clutch is a device that limits torque transmitted by the flexible shaft by slipping when the torque applied to it exceeds the set limit. The slip clutch or torque limiter includes a first pressure plate 132 with an integrally connected hub 134, a pair of friction facings 136, a second pressure plate 138, a disk spring 140 and an adjustment nut 142. The hub 134 has an opening therethrough 135 for receiving and holding the second end 130 of the coiled core of the flexible shaft, e.g., by a splined connection. A torque limiter coupling 144 may be used to mount the drive shaft 110 to the slip clutch, e.g., by a bolted connection. The coupling 144 preferably has a double chain coupling design 146 to accommodate angular and parallel misalignment of the coiled core and the drive shaft. The coupling includes a center plate 148 that is mounted between the friction facings 136. The adjustment nut is tightened onto the hub until the desired torque setting is obtained. Torque limiters and couplings of the type described above are well known to those skilled in the art and are available, for example, from the Morse company. A slip clutch cover 133 may be used to enclose the assembly.

With reference now to FIGS. 5 and 6A, the passenger car (mounted to upper frame 44) may be steered by simply looping a belt 150 directly around the outer periphery of both the rotating pinion pulley 104 and the outer race 78 of the turntable ring bearing, the latter of which acts as a fixed pulley. Rotation of the steering wheel by a passenger will rotate the coiled core 126 of the flexible shaft in the same direction, which in turn causes the slip clutch 122 to rotate. If the torque applied is less than the preset limit, the friction facings 136 will remain engaged with the center plate 148 of the coupling 144, causing the coupling and the drive shaft 110 to rotate up to the torque limit of the slip clutch. The drive shaft in turn will rotate the pinion pulley, causing the belt to rotate against the fixed outer race of the turntable ring bearing and causing the passenger car to turn with respect to the chassis. In this situation, however, wherein the belt is simply looped between the pinion pulley and turntable ring bearing, the passenger car will not be "right steering." In other words, turning the steering wheel to the right will cause the car to rotate to the left.

"Right steering" is obtained in the invention by incorporating the pair of idler pulleys 106 and 108 (see FIG. 6). The belt 150 is wrapped around the outer race 78 of the turntable ring bearing (which acts as a fixed pulley) and both idler pulleys with the belt contacting the pinion pulley 104 on the side of the pinion pulley nearest the turntable ring bearing. Contact pressure between the belt and the pinion pulley is created by the two idler pulleys. A belt drive tensioner 152 may be used to adjust the contact pressure (see also FIG. 6B). Preferably, the belt 150 has teeth on both sides. As noted earlier, the pinion pulley and outer race of the turntable ring bearing have peripheral teeth 81, 114, respectively, for engaging respective sides of the toothed belt. Thus, when torque is applied to the steering wheel, the pinion pulley rotates the belt against the fixed outer race of the turntable ring bearing resulting in the passenger car turning with respect to the chassis. In this embodiment, a right turn of the steering wheel causes a right turn of the car to resemble an automobile steering system.

With reference now to FIGS. 6 and 6D, a lap bar assembly 600 is shown having two crank arms 602 rotatably mounted to the upper frame 44. A shaft 604 for each crank arm is located by a pillow block bearing 606. Each crank arm has an upper end 608 fastened to the lap bar 102 (see also FIG. 2) and a lower end 610 that extends below the upper frame. A return spring 612 is fastened between the lower end of the crank arm and a spring tensioner 614 that is adjustably mounted to the upper frame.

A hydraulic actuator 616 having a first end 618 and a second end 620 is mounted at its first end to the lower end 610 of the crank arm. The second end of the hydraulic actuator is mounted to an actuator mount 622. The second end of the hydraulic actuator includes a pin valve 624 (see FIG. 6E) that, when depressed, permits a cylinder rod 626 of the hydraulic actuator to either extend or retract. Accordingly, with the pin valve depressed, a passenger or ride operator is free to lower the lap bar to the closed position or raise the lap bar to the open position (see FIG. 2). When the pin valve is not depressed, the cylinder rod is locked in place.

With reference to FIG. 6E, the actuator mount 622 includes a top plate 628, a generally triangular shaped base plate 630 and a support wall 632 for mounting the actuator mount to the upper frame. Extending perpendicularly from the support wall between the top plate and the base plate is a mounting plate 634 that defines an opening 635 for receiving the second end 620 of the hydraulic actuator therethrough.

A trigger assembly 636 for depressing the pin valve 624 is mounted to the second end 620 of the hydraulic actuator. The trigger assembly includes a trigger body 638 and a trigger lever 640. The trigger body defines an outer opening 642 for receiving the pin valve, a threaded bore 644 for threadably receiving the second end of the hydraulic actuator and a counter-bore 646 for receiving a spring 648 that biases the trigger body away from the mounting plate 634. The trigger body is also fixed to the second end of the hydraulic actuator by a set screw 637. The trigger lever 640 is a bar having an upper portion 650 that is pivotally mounted to the trigger body about pivot pin 652. An upper end 654 of the trigger lever, above the pivot pin, is received within a notched portion 656 of the actuator mount 622 (see also FIG. 6). The trigger lever 640 is thus permitted to rotate clockwise about the pivot pin 652 (as viewed in FIG. 6E), but is blocked from counterclockwise rotation by the notched portion 656.

In the loading station of the amusement ride, the lap bar is typically in the raised position to permit passengers to enter the passenger car. In the raised position, the passengers or a ride operator may freely lower the lap bar to lock it in place. This is done by pulling the lap bar down, which causes the crank arms 602 to rotate clockwise (as viewed in FIG. 6D). This in turn pulls the hydraulic actuator 620 and the trigger body 638 to the left (as viewed in FIGS. 6D and 6E). Because the trigger lever 640 bears against the notched portion of the actuator mount 618, the trigger lever will rotate clockwise about the pivot pin 652, causing the trigger lever to depress the pin valve 624 of the hydraulic actuator, releasing the lap bar. When the passengers stop pulling the lap bar or if they attempt to push the lap bar back up, the cylinder rod and trigger body will move to the right, causing the pin valve to be released and locking the lap bar in place.

Figure 7A:
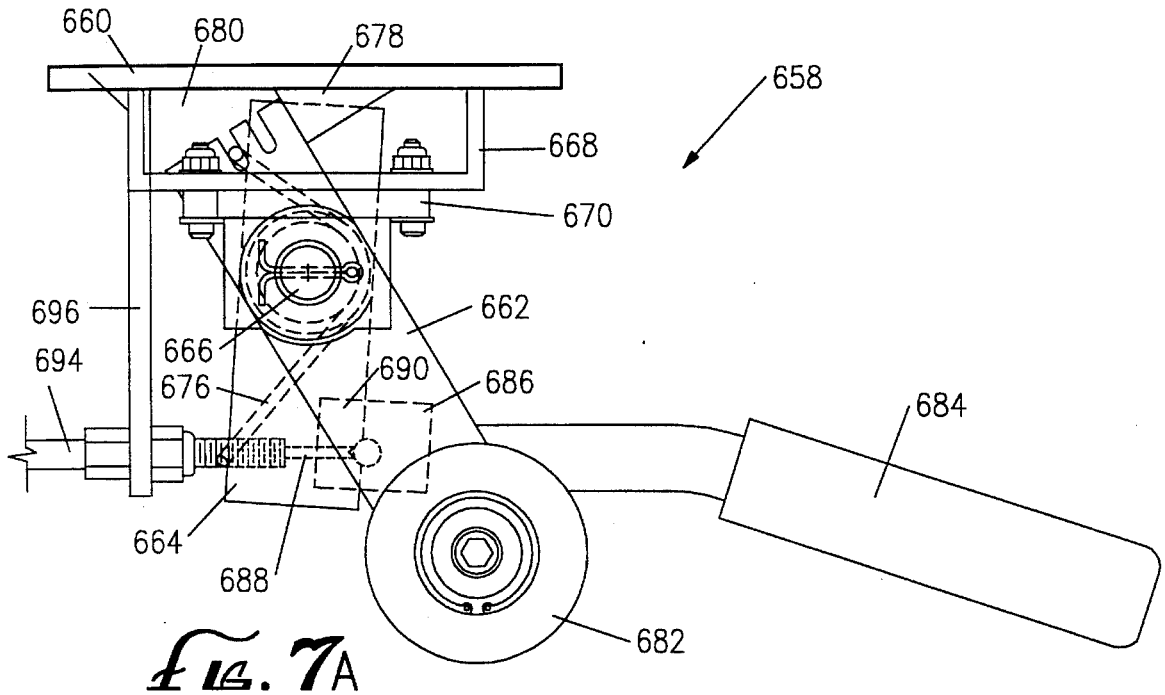
FIG. 7A is a side view of a cable release arm assembly for the preferred embodiment of the present invention.
Figure 7B:
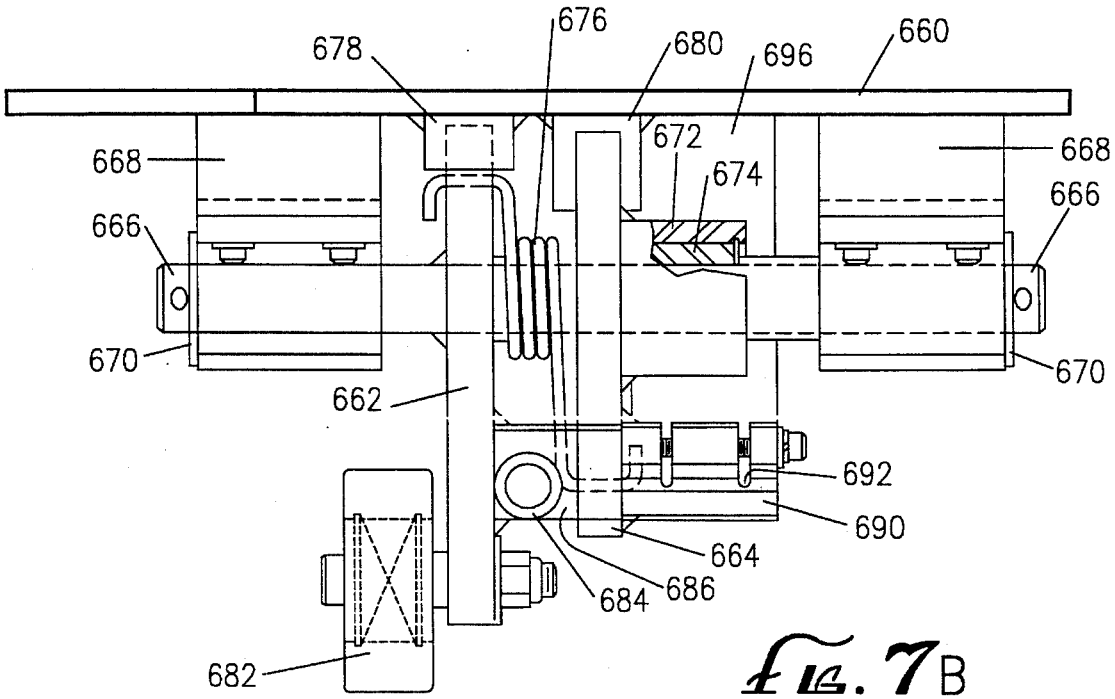
FIG. 7B is a rear view of the cable release arm assembly shown in FIG. 7A.

With reference now to FIGS. 6D and 7A–7B, a lap bar release assembly 658 is shown having a mounting plate 660, a release arm 662 and a cable pull arm 664. A shaft 666 is rotatably supported from the mounting plate by brackets 668 and pillow block bearings 670. The release arm is fixed to the shaft whereas the cable pull arm is rotatably mounted to the shaft by a support 672 and a bearing 674. A torsion spring 676 is fastened between the release arm and the cable pull arm. Extending down from the mounting plate is an angled block 678 that blocks rotation of the release arm in a clockwise direction and a plate 680 that blocks rotation of the cable pull arm in a counterclockwise direction (as viewed in FIG. 7A). Mounted to the lower end of the release arm is a guide wheel 682. A hand grip 684 is also mounted to the release arm by a bracket 686, with the bracket bearing against the lower end of the cable pull arm 664.

With reference now also to FIGS. 6D and 6E, a cable 688 is connected between the trigger body 638 and a bracket 690 extending from the cable pull arm. The bracket has two notches 692 for receiving two cables, one from the lap bar assembly 600 on each side of the upper frame. A sheathing 694 for each cable is fastened at one of its ends to the trigger lever 640 and at its other end to a cable mount 696 extending down from the mounting plate 660.

To release the lap bar, a ride operator need only raise the hand grip mounted to the release arm 662. Alternatively, a ramp 698 may be formed on the show floor of the amusement ride to engage and raise the guide wheel (FIG. 6D). In either case, the release arm will rotate counterclockwise, causing the cable pull arm 664 to also rotate in the same direction through the action of the torque spring. The cable pull arm will then pull the cable to the right. At the same time, an opposite force is applied to the sheathing 694 around the cable which is fixed in place. These opposed forces between cable and sheathing are transmitted to the trigger assembly 636 and result in the trigger body 638 and trigger lever 640 being squeezed together. A clockwise rotation of the trigger lever depresses the pin valve 624, permitting the lap bar to be raised automatically by the spring tensioner 614 and return spring 612.

Less than one-half inch movement of the lap bar guide wheel 682 is required to operate the trigger assembly. In order to accommodate building tolerances, however, the release arm 662 is designed to accommodate greater rotation. In particular, when the release arm is activated, the cable 688 is pulled by the cable pull arm 664 until a point where the pin valve is completely depressed. After this point, the release arm can continue to rotate, with the over travel being taken up by the torsion spring 676 and the cable pull arm blocked from further rotation by the plate 680.

With reference again to FIG. 5, a spin shaft 154 is shown concentrically located inside the support tube 42. An upper end 156 of the spin shaft is fixedly mounted to the mounting ring 84 of the upper frame 44 by a tapered, friction-lock bushing 155, such that the spin shaft, upper frame and passenger car will spin together. The spin shaft is supported by a self-aligning bearing 158. A circumferential flange 170 vertically locates the spin shaft between the lower end 54 of the support tube and the self-aligning bearing. The bearing is mounted in a bearing housing 160 that is supported by a spin system support plate 162. The bearing housing and the spin system support plate have openings through which the spin shaft passes. Preferably, the self aligning bearing has spherically shaped rollers that allow for angular misalignment between the spin shaft and the bearing housing.

The bearing housing includes an upper annular plate portion 164 that is fastened between the base plate 58 and the spin system support plate 162. Extending down from the plate portion 164 through the opening of the spin system support plate is a ring portion 166 having a radially inwardly directed flange 168. The bearing 158 is press fit into the ring portion of the housing and seated on the flange 168. The circumferential flange 170 engages the top of the bearing such that there is a sliding fit between the bearing and the spin shaft 154.

Figure 8:
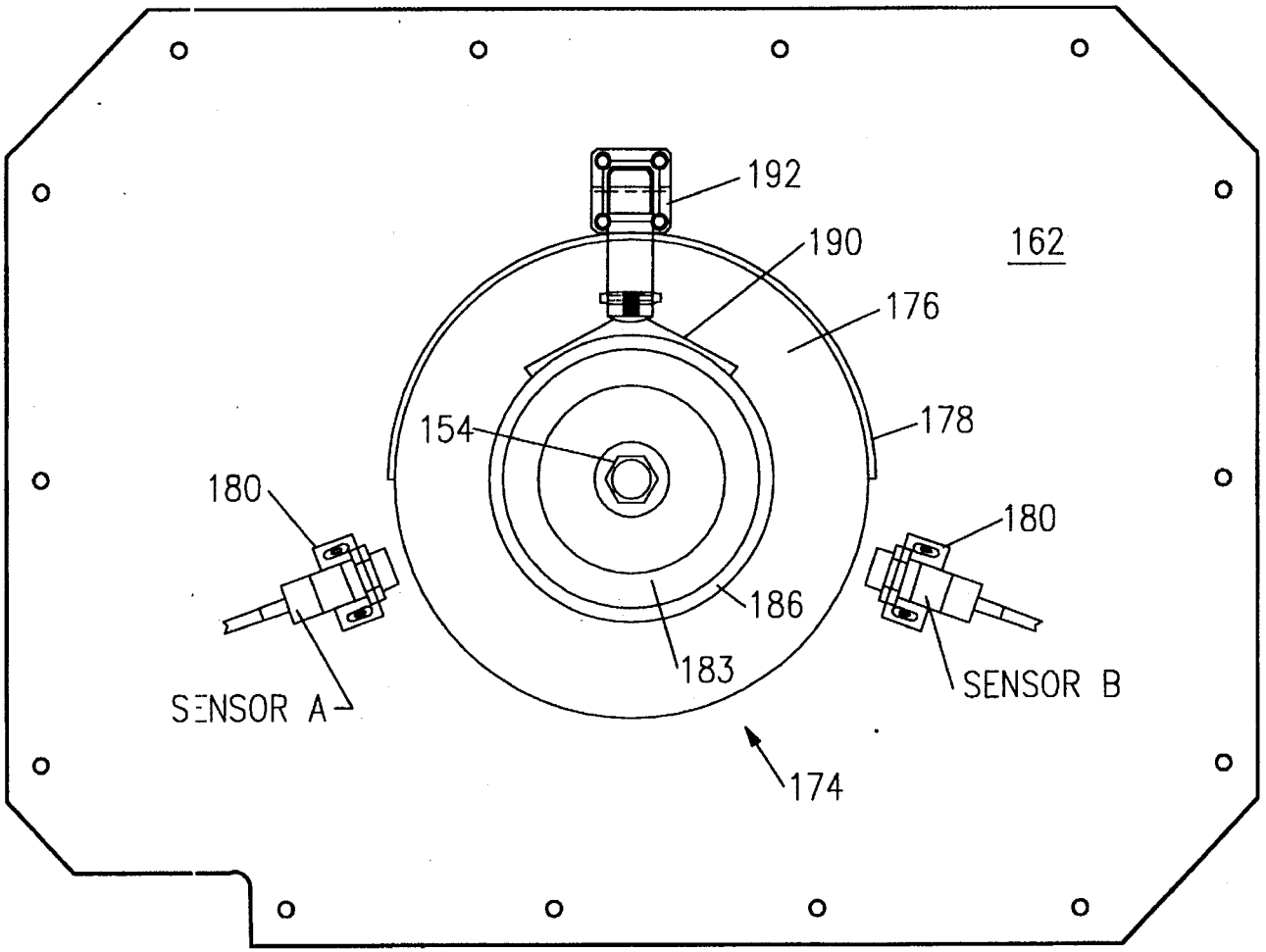
FIG. 8 is a bottom view of a spin system support plate for the preferred embodiment of the ride vehicle, with the indexing sprocket removed for clarity.

A lower portion 172 of the spin shaft 154 extends down below the spin system support plate 162 and is fixed to an indexing cam assembly 174. The indexing cam assembly preferably includes an inner non-metallic disk 176 (such as nylon) concentrically mounted to the spin shaft and a collar 175. The assembly may be mounted to the spin shaft by inserting a set screw 177 through the collar 175. With reference to FIG. 8, a semicircular metallic rim 178 (such as steel) is fastened, e.g., by fasteners, along the outer periphery of the disk. The indexing cam assembly is operable with a pair of index detection sensors, sensor A and sensor B, for determining whether the passenger car is in a "forward facing" condition, and if not, which direction the car should spin to achieve a forward orientation in the shortest distance possible. The sensors are preferably inductive proximity sensors of a 30 mm barrel type or "puck" type that will detect the metal rim when in close proximity therewith.

With further reference to FIG. 8, the index detection sensors A and B are shown mounted to and below the spin system support plate 162 by brackets 180 (an indexing sprocket 182 is removed from the figure for clarity). The sensors are directed toward the outer periphery of the disk of the indexing cam assembly and are separated by an arc of less than 180 degrees, and preferably, approximately 140 degrees. It will be appreciated that one or both sensors will be flagged or triggered when aligned with the metal rim, but will be blocked or unflagged when aligned with the exposed nonmetallic portion of the disk.

As will be described below, control logic will dictate when and in what direction to turn the spin shaft based on whether index detection sensor A and/or index detection sensor B or neither are triggered. For example, in a preferred embodiment, if sensor A is triggered, the spin shaft is rotated clockwise. If sensor A is not triggered, the spin shaft is rotated counterclockwise, if neither sensor A nor sensor B are triggered (as shown in FIG. 8), the spin shaft is not rotated, and the passenger car is determined to be in the forward facing direction. Of course, other orientations between the disk and sensors and different control logic may be used to achieve the same result, i.e., attainment of the forward orientation or other desired orientation in the shortest possible distance. Additionally, the spin shaft may be provided with a key or flat. The disk 176 is then provided with a corresponding keyway to properly align the metal rim relative to the sensors.

With reference again to FIG. 5, an indexing sprocket 182 is also fixed to the lower portion of the spin shaft 154, preferably below the indexing cam assembly 174. The sprocket has a tapered bore 183 and is mounted to the spin shaft via a friction-lock bushing 184 by fasteners 185. Torsion is transferred by means of a key in a keyway 187. The outer periphery of the sprocket may be toothed 189 to engage a toothed belt.

The lower portion of the spin shaft may also be used to carry a slip ring 186 for collecting electrical power from the chassis and transmitting it through the spin shaft to the passenger car. The slip ring is fastened to the bottom of the spin shaft by a slip ring mount 188. The slip ring receives electrical power from a brush block 190 that is mounted to and below the spin system support plate 162 by a bracket 192 (see also FIG. 8). In the preferred embodiment, the spin shaft is hollow in order to provide wiring (not shown) from the slip ring to the passenger car to energize lights on the car.

Figure 9:
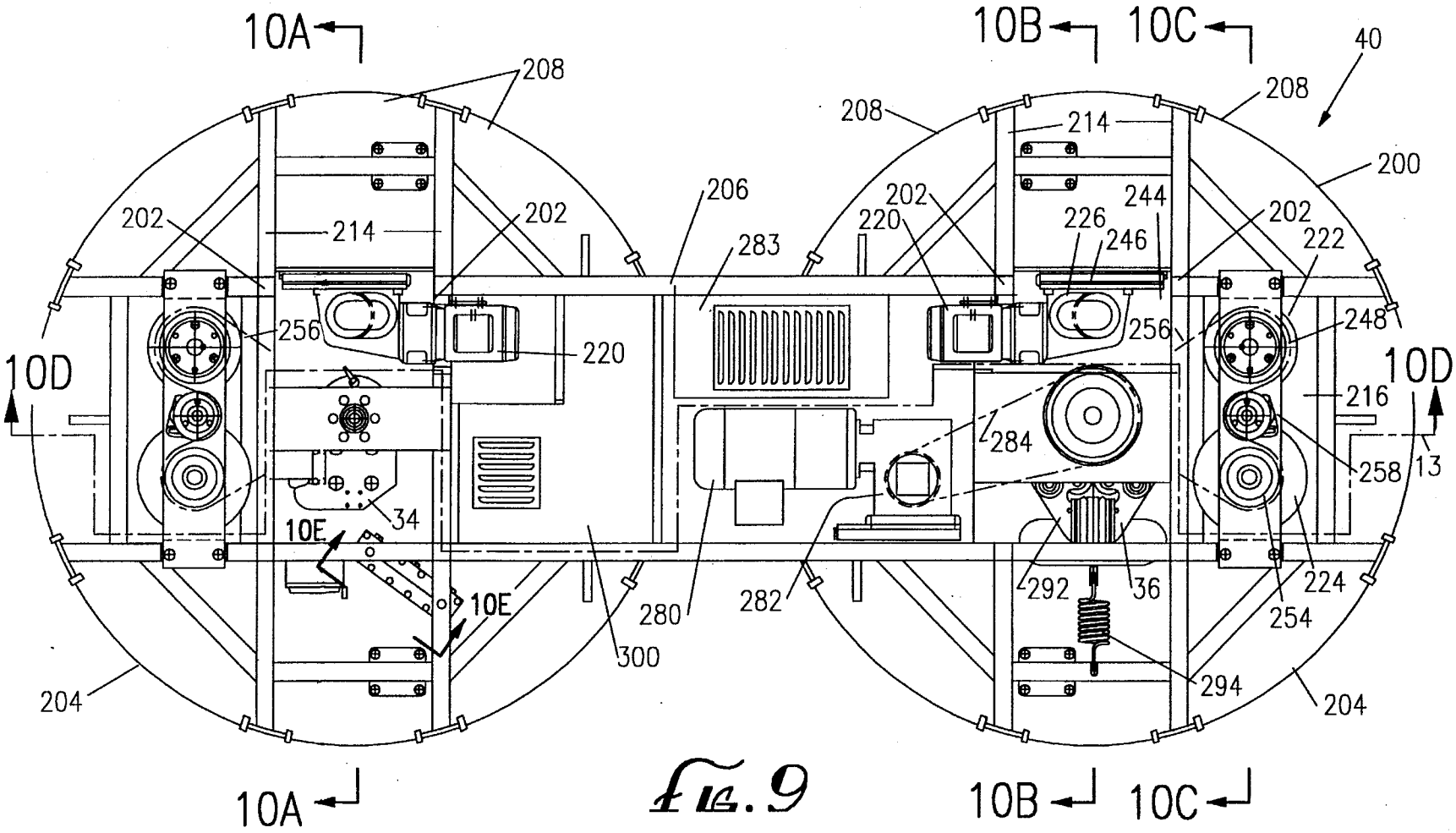
FIG. 9 is a plan view of a chassis for the preferred embodiment of the ride vehicle, with the elevated frame removed for clarity.

With reference now to FIGS. 9 and 10A–10E, the chassis 40 will be described in detail. In a preferred embodiment, the chassis includes a base frame 200 and an elevated frame 210 that is spaced above and mounted to the base frame by tubular columns 202 (FIG. 9 shows the elevated frame 210 removed for clarity). Tubular braces 214 may also be used to further support the elevated frame. The base frame and elevated frame are themselves made from a suitable structural material such as tubular steel beams.

The base frame 200 has a barbell-shape including two circular ends 204 and a narrower connecting bridge 206. The shape of each circular end 204 is formed by a number of bumper pieces 208 that are fastened to the beams making up the base frame. Preferably, the circular ends are located directly below their respective passenger cars and the size of the circular ends are larger than the envelope of the spinning cars so that if two vehicles collide, the fiberglass bodies of the passenger cars do not hit one another. The barbell-design allows the chassis to turn sharper corners than could be achieved by a straight sided chassis. In effect, as the chassis turns the corner, the circular ends define the chassis clearance envelope. If the chassis were straight sided, additional clearance would be required to avoid structural supports which may be used, for example, to support the show floor.

The elevated frame 210 has the same width as the bridge 206 of the base frame, but is shorter in length than the base frame. Each end of the elevated frame supports a respective support tube 42 and upper frame 44 combination (see also FIGS. 2 and 5). In particular, each spin system support plate 162, to which a respective support tube and spin shaft are mounted, is fastened directly to angle supports 212 on the elevated frame.

The base frame supports a drive mechanism for the vehicle, including a drive motor 280, a drive gear box 282, a motor control box 283, a drive belt 284 and the pinch roller drive mechanism 36 referred to earlier. The pinch roller drive mechanism includes a drive wheel 286 having a drive shaft 288 that is driven by the belt 284 from the drive gear box 282 (FIG. 10B). Opposite the drive wheel is a pair of pinch wheels 290 that together with the drive wheel 286 pinch the inverted "T" beam of the track 24. The drive wheel grip force is applied by springs 292. The spring force can be pneumatically removed by injecting air into pneumatic tubing 294. The vehicle is propelled by the friction drive force developed between the rotating drive wheel and the track 24 whenever the pinch wheels are activated.

The base frame also supports the guide bogey assembly 34 referred to earlier. The guide bogey assembly also holds the collector shoes 39 that ride along the bus bars 37 and collect power for the vehicle (FIG. 10A). The guide bogey assembly is rotatably mounted to the front of the chassis by a support 296. Bogey wheels 295 engage the track 24 and guide the front of the chassis, permitting the chassis to freely follow the track as the track changes direction along the ride course.

Figure 10C:
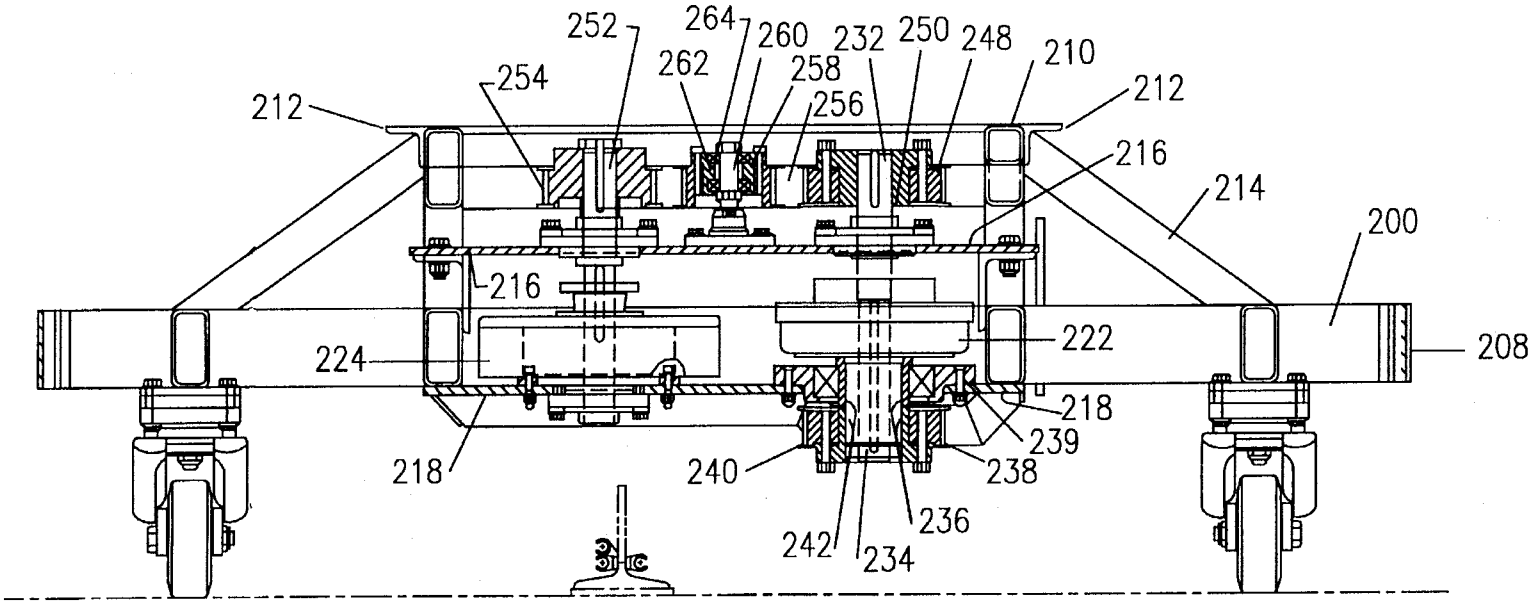
FIG. 10C is a sectional view of the chassis shown in FIG. 9 taken along line 10C—10C, with the upper frame included.
Figure 10E:
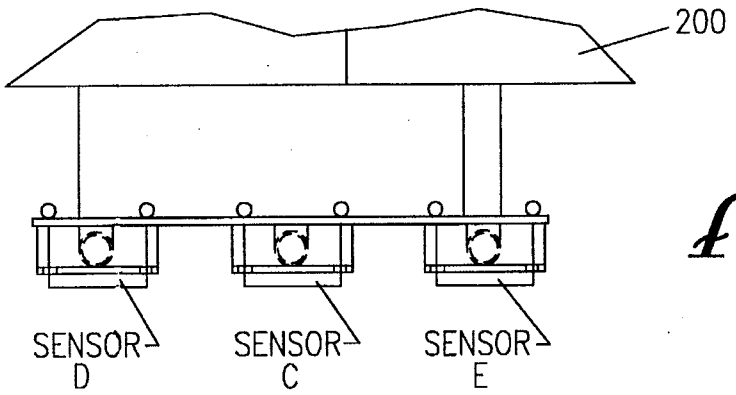
FIG. 10E a side view of the chassis shown in FIG. 9, taken along line 10E—10E.
Figure 10D:
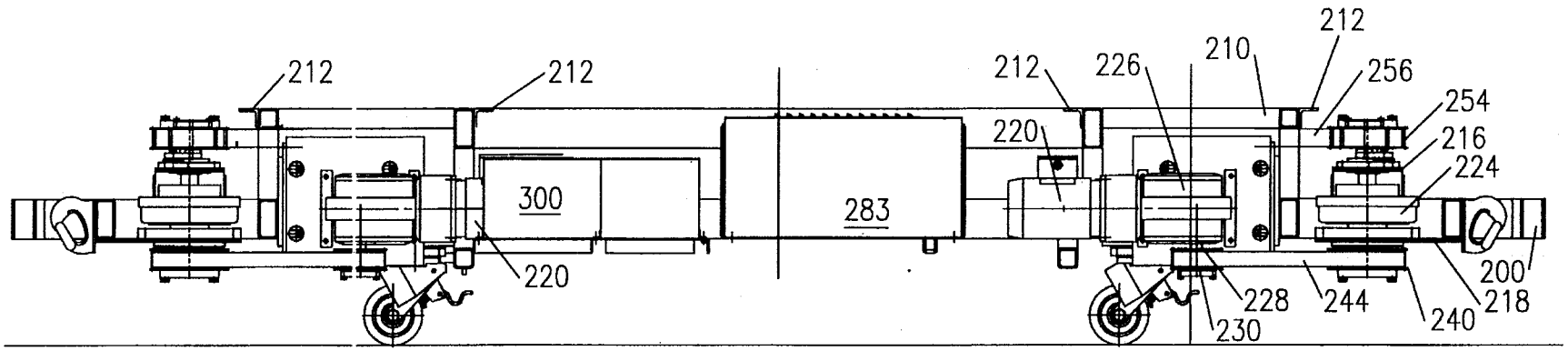
FIG. 10D is a sectional view of the chassis shown in FIG. 9 taken along line 10D—10D, with the upper frame included.

The base frame 200 of the chassis also supports various components useful for the indexing operation, including an indexing motor 220, an indexing clutch 222 and a spin brake 224. The indexing motor includes a gear box 226 for driving a drive shaft 228 that extends vertically downward and terminates in a drive sprocket 230 located below the base frame (FIGS. 10B and 10D). Preferably, a one horsepower a/c 3 phase motor is used with a 60/1 ratio right angle worm gear gearbox.

The indexing clutch 222 and the spin brake 224 are mounted to and between a pair of support plates, an upper support plate 216 and a lower support plate 218. The indexing clutch includes an upper clutch shaft 232 and a lower clutch shaft 234 (FIG. 10C). The lower clutch shaft is fixed to a bearing bushing 236 and located by a bearing 238. The bearing is located in a bearing housing 239. A lower clutch sprocket 240 is mounted to the end of the lower clutch shaft by a sprocket bushing 242. The lower clutch sprocket is below the base frame and vertically aligned with the drive sprocket 230 (see also FIG. 10D). A belt 244 is wrapped around both for driving the lower clutch shaft. A slide mount 246 may be fastened to the base frame adjacent the drive shaft 228 to adjust the tension in the belt 244. An upper clutch sprocket 248 is mounted to the end of the upper clutch shaft 232 by a sprocket bushing 250. The upper clutch sprocket 248 is in vertical alignment with the indexing sprocket 182 mounted on the lower portion of the spin shaft 154 (see FIG. 2).

The spin brake 224 has a brake shaft 252 that extends vertically upward from the spin brake, terminating in a brake sprocket 254 that is in vertical alignment with the upper clutch sprocket 248 and the indexing sprocket 182. Preferably, the spin brake is of a fail-safe type that prevents rotation of the brake shaft unless the spin brake is energized, in which case the brake shaft is free to rotate. An indexing belt 256 operably connects the indexing sprocket, the upper clutch sprocket and the brake sprocket (see FIGS. 2 and 9). An idler pulley 258 rotatably mounted to a shaft 260 extending up from the upper support plate 216 may be used to adjust the tension in the indexing belt 256. In the preferred embodiment, the idler pulley is mounted to the shaft 260 by a bushing 262 and a bearing 264.

It will be appreciated from the foregoing that each indexing motor 220 controls the direction of rotation of its respective passenger car. In particular, for each passenger car, the indexing motor will turn drive shaft 228, causing the belt 244 to turn the lower clutch sprocket 240 (FIG. 10D). If the indexing clutch 222 is engaged and the spin brake 224 is energized, the lower clutch shaft 234 will turn the upper clutch shaft 232 (FIG. 10C), causing the belt 256 to turn the indexing sprocket 182 at the lower end of the spin shaft 154 (FIG. 2). Accordingly, turning the drive shaft in one direction or the other dictates the direction of rotation of the passenger car. Control logic will dictate when and in what direction to turn the drive shaft and also will dictate when the indexing clutch and spin brake are to be energized or de-energized.

Suitable motors, gearboxes, clutches and brakes for use in the above described indexing operation as well as the associated shafts, belts, sprockets and pulleys are well known to those skilled in the art. It will also be appreciated that various arrangements and combinations of the above components or equivalents thereof may be used to achieve the same result.

Preferably, an on-board relay based control system 300 is used to control the indexing motors, the spin brakes and the indexing clutches. The control logic for the indexing operation is a function of the interaction of index detection sensor A, index detection sensor B and the indexing cam assembly 174, as previously described in connection with FIG. 8, and is also a function of three additional sensors (sensors C, D, E) that are mounted to the bottom of the base frame 200, facing downward (see FIG. 10E). Sensors C, D, E are of a type similar to index sensors A, B and are located on the chassis such that they will detect targets laid out along the ride course 12. In particular, with reference again to FIG. 1, a first metal target X may be placed on the ride course adjacent the loading station 16 to flag sensor C. Control logic may use this information to energize the spin brake, permitting passengers who are beginning the ride to freely spin their passenger car. The clutch should also be deenergized to permit the passengers to spin the passenger car without having to overcome the inertia of the indexing motor. A second metal target Y may be used to flag sensor D at a location on the ride course just prior to where a ride vehicle enters the indexing station 20. Control logic may use this information to engage the spin brake, stopping the passenger car from spinning as it enters the indexing station. A third metal target Z may be placed on the ride course at the start of the indexing station to flag sensor E. Control logic may use this information to begin the indexing operation, which causes the passenger car to rotate to its forward orientation.

To summarize the indexing operation, when the vehicle is unpowered, both spin brakes will be engaged, both index motors will be off and both index clutches will be disengaged. When power is initially applied to the vehicle, there will be no change in the state of this equipment. Sensor C ("disengage spin brake" sensor) will drive a self-latching relay circuit which disengages both spin brakes by energizing coils in both units. Sensor D ("engage spin brake" sensor) will unlatch the above mentioned relay circuit, thus applying the spin brakes by de-energizing coils in both units. Sensor E ("start indexing" sensor) will drive two self-latching relay circuits, one for each passenger car. Relay logic will use the two index detection sensors (sensors A, B) on each passenger car to determine whether the forward orientation is achieved, and if not, which direction the car should spin to achieve a forward orientation in the shortest possible distance. Once the passenger car is pointed forward, the relay circuit will unlatch, turning off the indexing motor and the indexing clutch for the appropriate passenger car. The indexing operation should not allow the passenger car to "hunt" (oscillate back and forth) if the passenger car overshoots the forward position. Preferably, at least five degrees of overshoot should be expected and should not be compensated.

Figure 11A:
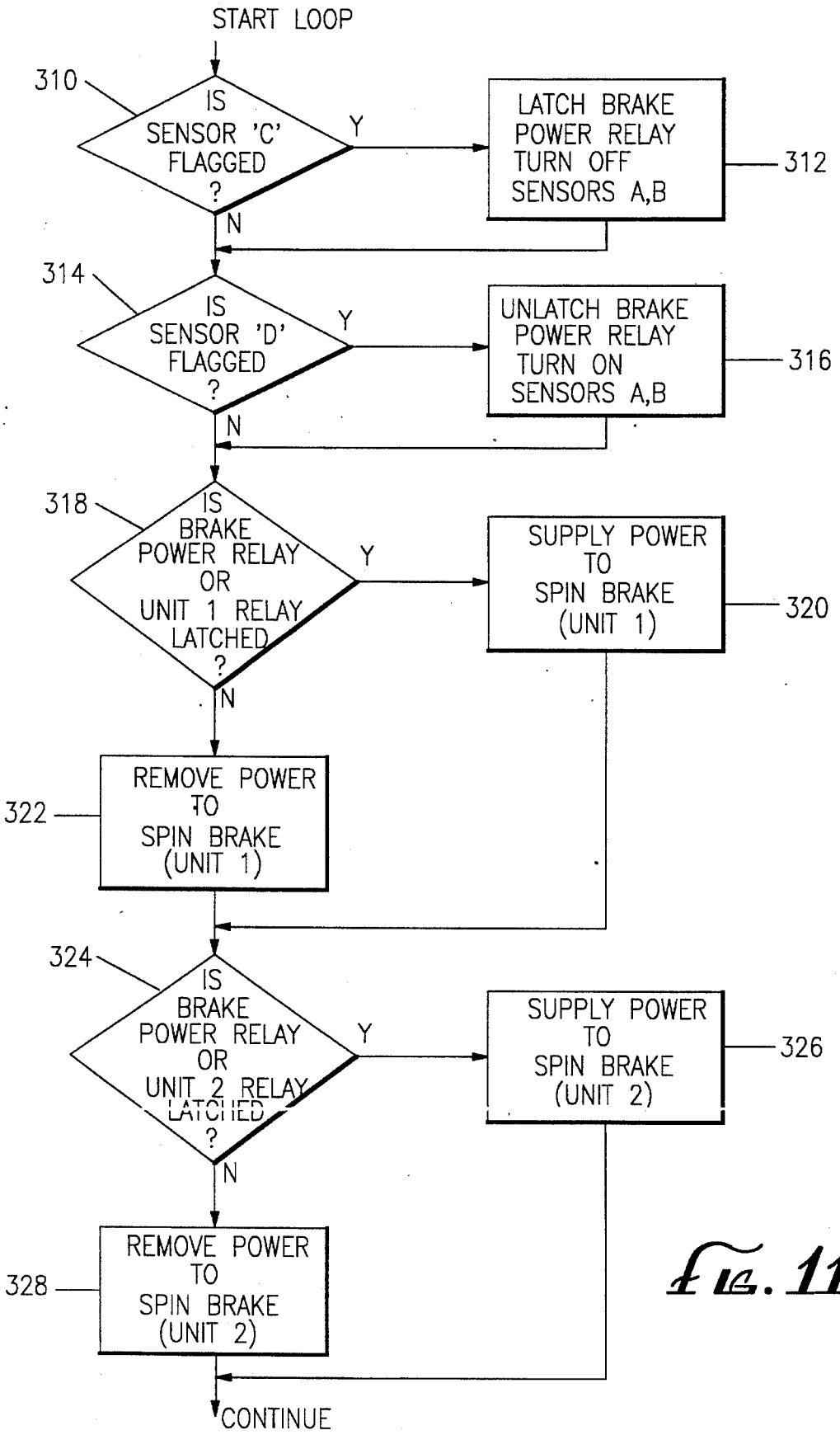
FIG. 11A–B is a flow chart showing the preferred control logic for the indexing system of the present invention.
Figure 11B:
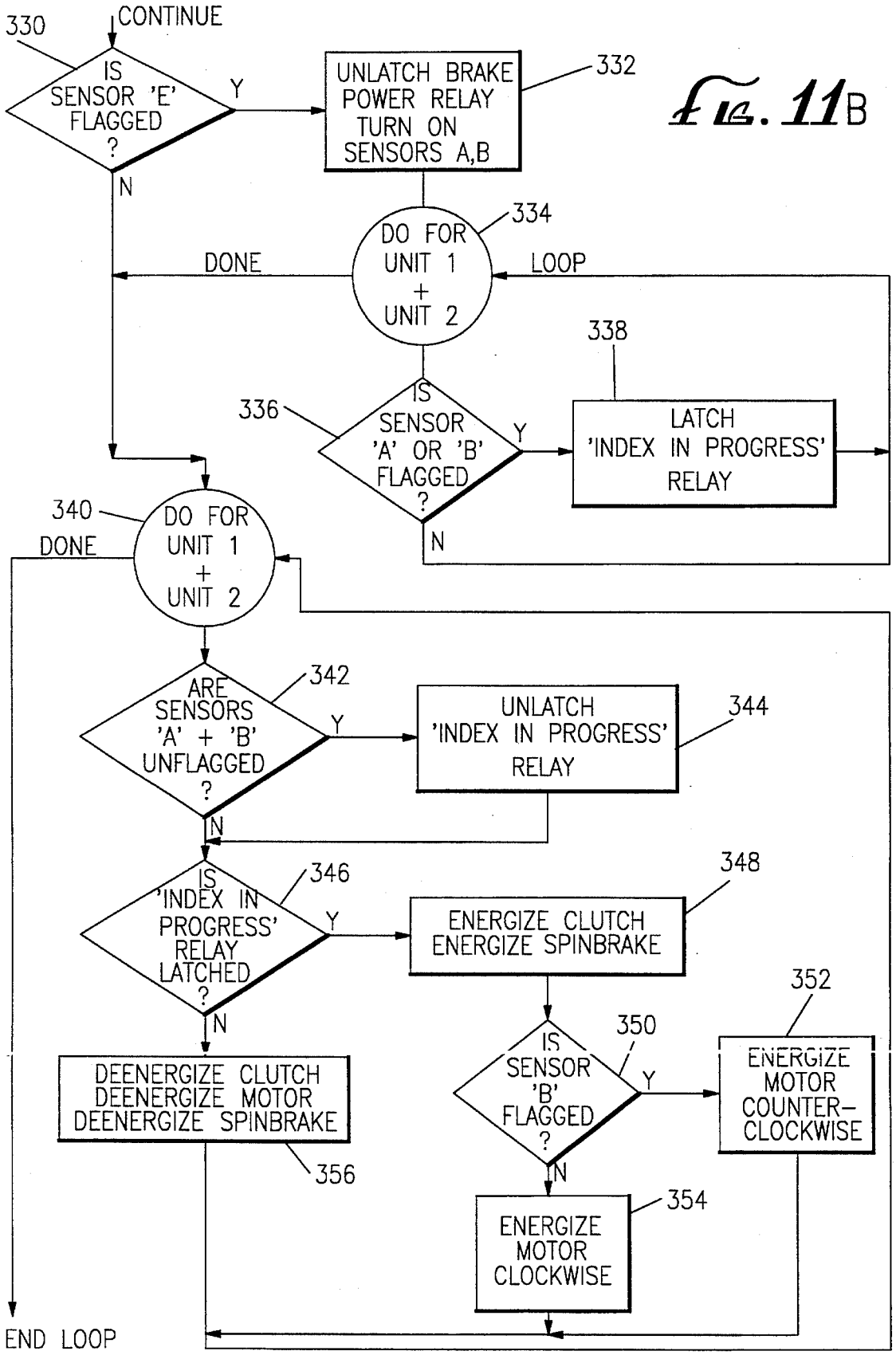

With reference now to the flow chart shown in FIG. 11A–B, the preferred control logic for the indexing system will be described in detail. The control logic is run as a continuous loop during the operation of the ride. In step 310, it is determined whether or not the "disengage spin brake" sensor C is flagged. As noted earlier, target X is located on the ride course such that it will trigger sensor C shortly after the ride vehicle leaves the loading station 16. If sensor C is flagged, then in step 312 a spin brake power relay is latched and the index sensors A and B for each passenger car are turned off. Once power is supplied to the spin brake power relay, the spin brakes will disengage and passengers will be free to spin their respective passenger cars. Additionally, during this phase of the ride, the indexing operation will not be engaged, therefore the clutch is disengaged and the index sensors need not be operating.

Regardless of the determination in step 310, the next step 314 determines whether or not the "engage spin brake" sensor D is flagged. Target Y is located on the ride course such that it will trigger sensor D when the ride vehicle enters or is near the indexing station 20. If sensor D is flagged, then, in step 316, the spin brake power relay is unlatched, cutting off power to the spin brakes. Also, the index sensors are turned on. At this time, the spin brakes are engaged and the passengers will be unable to spin their respective passenger car. Moreover, if a passenger applies too great a force to the steering wheel while the spin brake is engaged, the steering wheel will slip due to the slip clutch 122. Also, because the vehicle is approaching the end of the ride, the index sensors are turned on to prepare for the indexing operation. Preferably, the vehicle has stopped spinning before the indexing operation begins.

Whether or not the "engage spin brake" sensor D is flagged, the next step 318 is to determine (1) if the spin brake power relay is latched or (2) if a spin brake unit relay for a first of the two passenger cars (unit 1) is latched. If either situation is present, then power is supplied to the spin brake for unit 1, disengaging that spin brake (step 320). If neither situation is present, then, in step 322, power is removed from the spin brake for unit 1, engaging that spin brake.

Next, in step 324 the same determination as in step 318 is made for the second of the two passenger cars (unit 2). If the spin brake power relay is latched or if a spin brake unit relay for unit 2 is latched, then power is supplied to the spin brake for unit 2, disengaging that spin brake (step 326). If neither situation is present, then, in step 328, power is removed from the spin brake for unit 2, engaging that spin brake.

Next, in step 330 it is determined whether or not the "start indexing" sensor E is flagged. As noted earlier, target Z is located on the ride course such that it will trigger sensor E when the ride vehicle reaches the appropriate spot in the indexing station for turning the passenger cars to a forward orientation. If sensor E is flagged, then the spin brake power relay is unlatched (step 332), the index sensors A and B are turned on (step 332) and, for each passenger car (step 334), a determination is made whether or not the index detection sensors A or B are flagged (step 336). As previously noted in connection with FIG. 8, one or both index detection sensors are flagged if placed in close proximity to the metal rim 178 of the indexing cam assembly 174. Accordingly, if sensor A or sensor B is flagged for unit 1, then, in step 338 an "index in progress" relay is latched. The same determination is also made for unit 2 (step 334).

Regardless of whether or not the "start indexing" sensor E is flagged, the next step 340 requires, for each passenger car (step 340), a determination of whether or not both index sensors A and B are unflagged (step 342). If both index sensors are unflagged for unit 1, then, in step 334 the "index in progress" relay for unit 1 is unlatched. This means that unit 1 is considered to be in a forward orientation. If, however, both index sensors A and B for unit 1 are not unflagged, then in step 346, a determination is made whether or not the index in progress relay for unit 1 is latched. If so, then, in step 348, the index clutch 222 for unit 1 is energized such that rotation of the lower clutch shaft 234 will result in rotation of the upper clutch shaft 232 (FIG. 10C) and the spin brake for unit 1 is energized, disengaging the spin brake. Next, in step 350, a determination is made whether or not index sensor B for unit 1 is flagged. If so, in step 352, the indexing motor 220 is energized to turn the unit 1 passenger car counterclockwise. If not, in step 354, the indexing motor is energized to turn the unit 1 passenger car clockwise. Finally, for unit 1, if the "index in progress" relay is unlatched, then in step 356, the indexing clutch for unit 1 is de-energized, the indexing motor for unit 1 is deenergized and the spin brake unit relay for unit 1 is unlatched. The same sequence (steps 342–356) is then performed for unit 2. It will be appreciated from the above description that the indexing operation for each passenger car is complete when both index sensors are unflagged, thus signifying that each car is in the forward orientation.

Figure 12A:
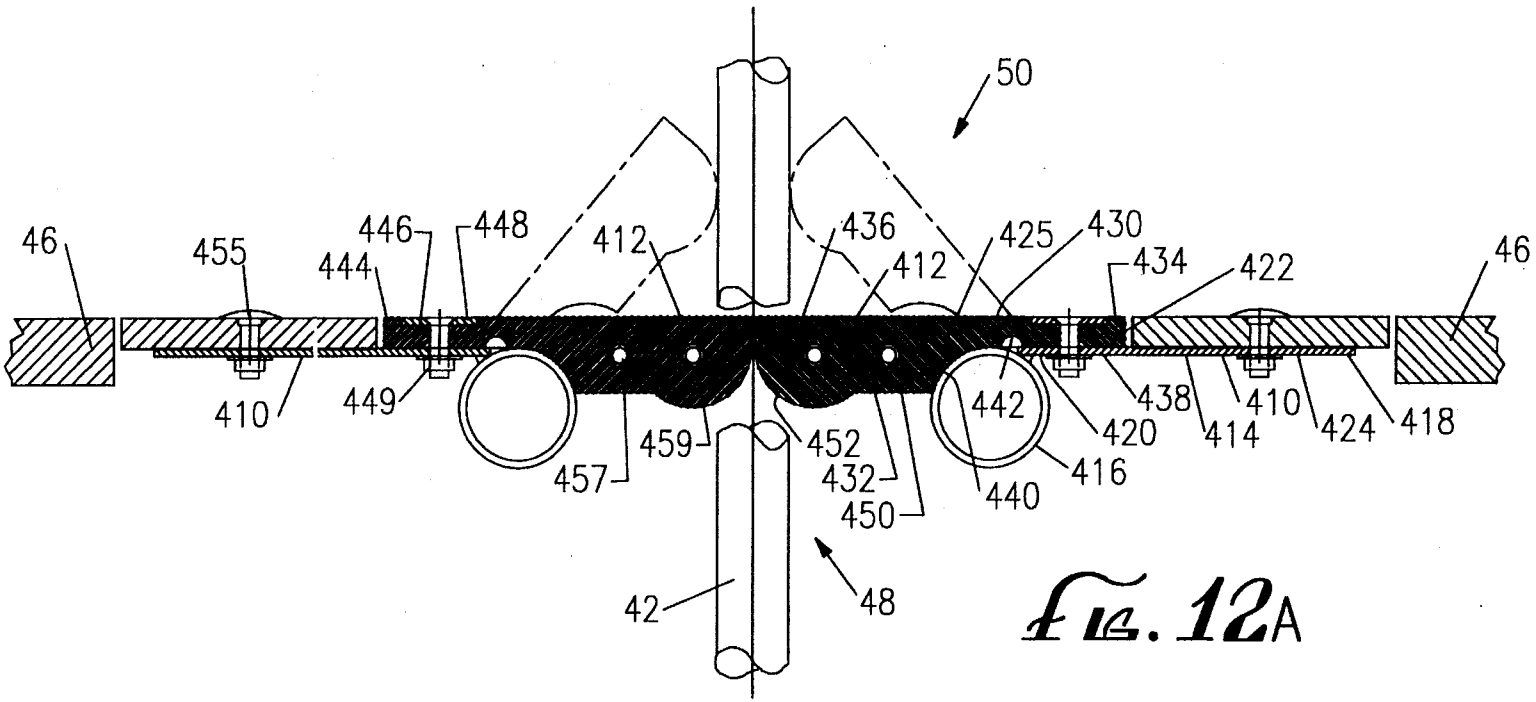
FIG. 12A is a sectional view of a preferred embodiment of a slot cover of the present invention, taken along line 12A—12A of FIG. 14A.

With reference now to FIG. 12A, the slot cover 50 for slot 48 will be described in detail. The slot cover includes a pair of rigid support brackets 410, preferably made of steel, and a pair of resilient covers 412, preferably made of extruded rubber. Each rigid support bracket includes a plate portion 414 and a tube portion 416. The plate portion has a first end 418, a second end 420, a flat upper surface 422 and a flat lower surface 424. The tube portion is fixed to the second end of the plate portion, for example by welding, such that the flat upper surface of the plate portion represents a tangent line intersecting the outer circumference of the tube portion. The tube portion has an outer surface 425 extending downwardly into the slot. Opposed tube portions, extending into the slot from opposite sides of the slot, are spaced apart from each other to permit the support tube to pass therebetween. Preferably, the support brackets are made in ten foot lengths.

Each resilient cover 412 has a flat top surface 430, a bottom surface 432, a proximal portion 434 that is mounted to the upper surface 422 of the support bracket and a distal portion 436 that extends into the slot 48 of the show floor 46. The bottom surface of the proximal portion 434 of the cover has a first flat portion 438 and a concave portion 440 that are shaped to match the configuration of the flat upper surface of the plate portion and a portion of the circumference of the tube portion of the support bracket, respectively. Between the flat portion and the concave portion of the bottom surface of the cover is a lengthwise extending semi-circular notch 442. The bottom surface of the distal portion of the cover has a second flat portion 450 and a beveled or convex portion 452. The second flat portion extends distally from the tube portion of the support bracket and is parallel to the first flat portion 438. The beveled or convex portion is shaped such that when the cover is raised out of the slot, the cover will not strike the opposed cover mounted on the opposite side of the slot. Preferably, the resilient covers are also made in ten foot lengths.

The top surface 430 of the cover adjacent a proximal end 444 thereof, defines a lengthwise extending clamping notch 446. The clamping notch receives a rigid clamping strap 448 for fastening the support bracket and cover together, for example, by fasteners 449.

Figure 12B:
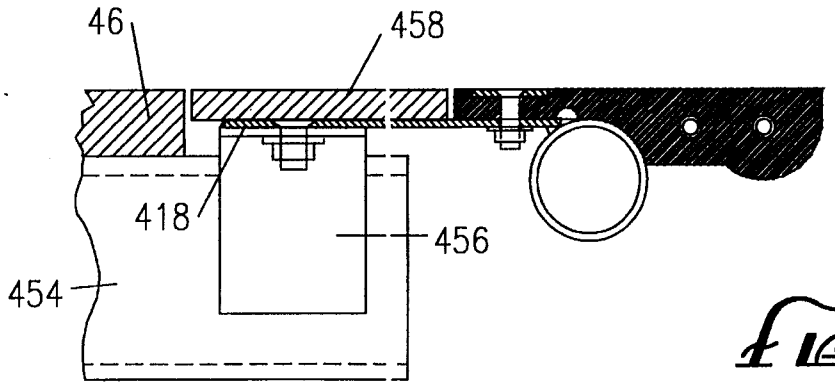
FIG. 12B is a sectional view of a portion of the slot cover in FIG. 12A supported by a mounting angle, taken along line 12B—12B of FIG. 14A.
Figures 14A, 14B:
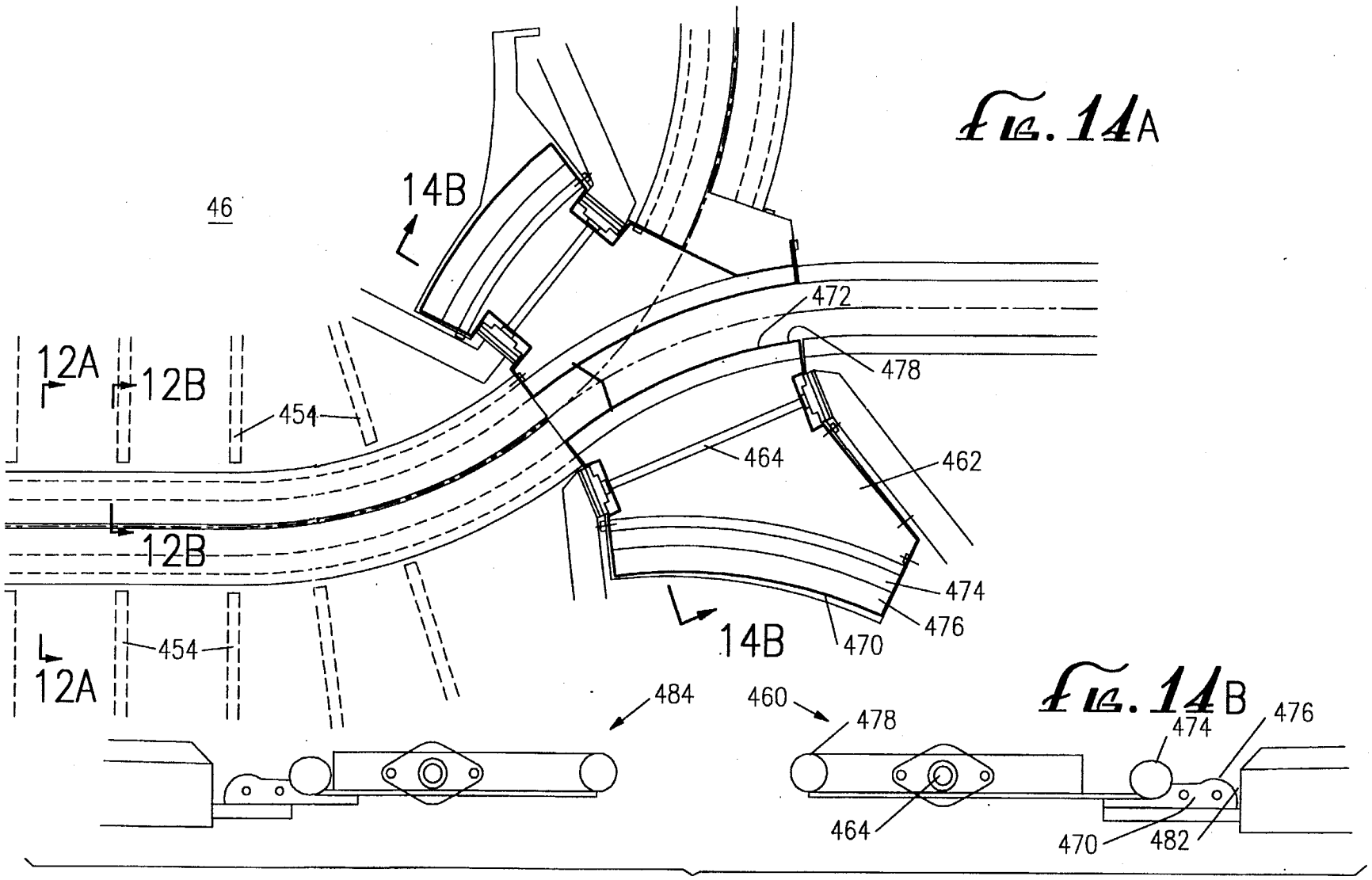
FIG. 14A is a plan view of the slot cover switch shown in a maintenance position.
FIG. 14B is a sectional view of the slot cover switch shown in FIG. 14A, taken along line 14B—14B.
Figures 15A, 15B:
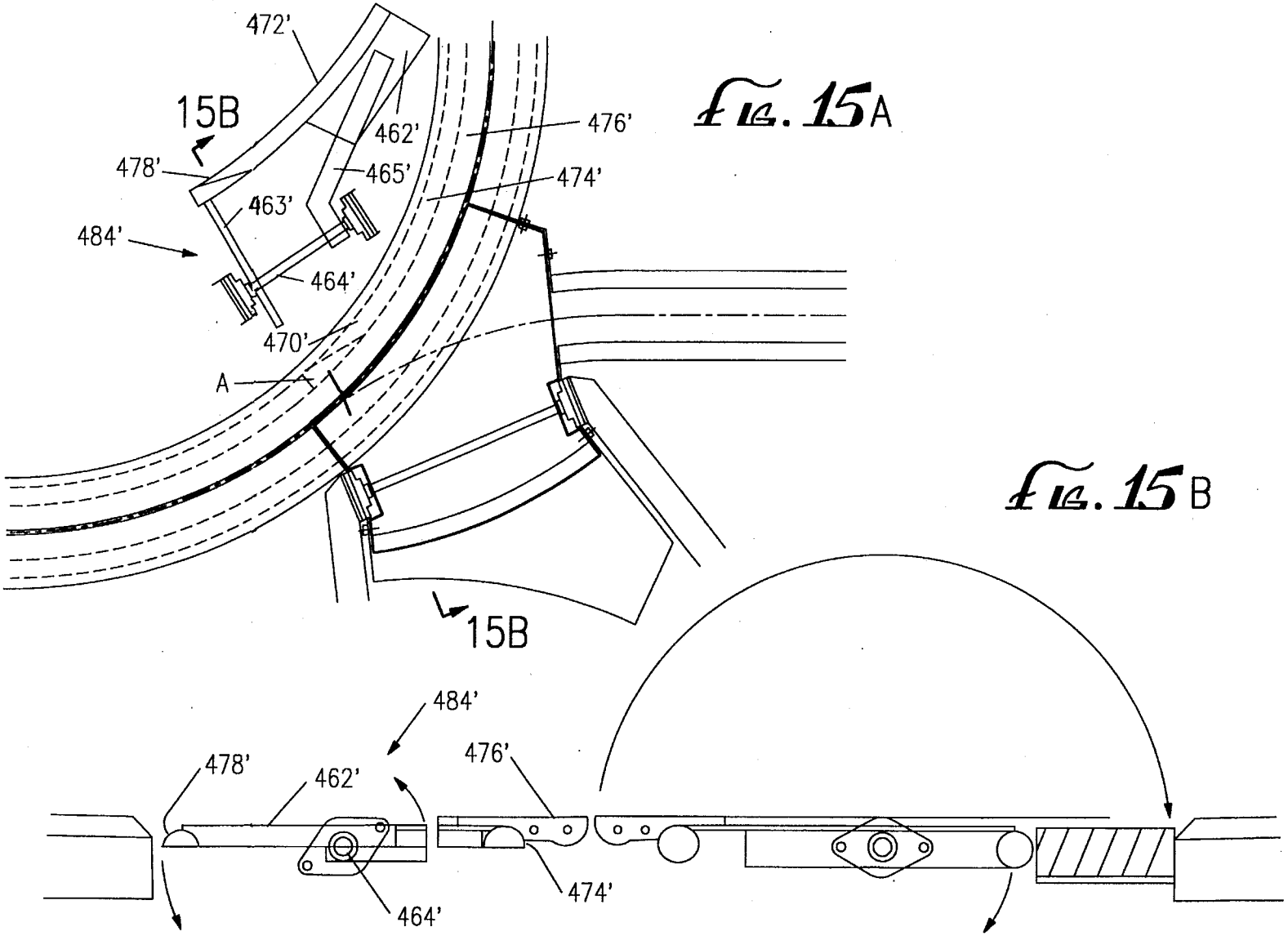
FIG. 15A is a plan view of an alternative slot cover switch shown in the main position.
FIG. 15B is a sectional view of the slot cover switch shown in FIG. 15A, taken along line 15B—15B.

The slot cover may be mounted to the show floor by any means commonly known to those skilled in the art. With reference to FIGS. 12B and 14A, the show floor 46 is shown supported by structural tubing 454. Mounting angles 456 are fastened to the structural tubing, for example by welding. The mounting angles are disposed at regular intervals along the slot for supporting the first end 418 of the plate portion of the support bracket. A filler piece 458, preferably made of plywood, is placed on top of the support bracket and is fastened to the support bracket at intervals intermediate of the mounting angles by fasteners 455 (see FIG. 12A).

The support brackets are mounted to each side of the slot with the tubular portions extending into the slot. Similarly, the resilient covers are mounted on the support brackets with their distal portions extending into the slot, preferably in opposed, contacting relationship to each other. A plow assembly 500 (FIGS. 17 AND 18) mounted to each spin shaft will raise the resilient covers out of the way as the support tube 42 passes through the slot. The semi-circular notches 442 provide a thin area in the cover that works as a hinge, permitting the cover to more easily rise up.

The distal portion 436 of each cover defines one or more lengthwise extending bores 457. Pins 459 may be inserted between bores of successive covers, providing a means of pinning the covers together in the lengthwise direction.

It will be appreciated from the above that the design of the slot cover does not permit for switching of the ride vehicle from a main portion of the ride course to the maintenance spur 30. For example, if the slot cover is used at the location of the maintenance spur, it will cover the slot on the main portion of the ride course, but will block passage of the ride vehicle into the maintenance spur when the track below is switched. Accordingly, with reference to FIGS. 13–16, a slot cover switch 460 will now be described.

The slot cover switch 460 preferably includes a metal plate 462 fixably mounted to a shaft 464. The shaft is rotatably mounted at each of its ends to a first support 466 and a second support 468. The plate includes a main track portion 470 and a spur track portion 472. A tubular support 474 is secured along the main track portion and a resilient cover 476 is mounted to it to form a slot cover as described above. The spur track portion also has a tubular support 478 welded along the outer edge thereof to keep the plow (described later) engaged properly. However, because the maintenance area is not expected to accommodate traffic from passengers or guests and because this area is illuminated during maintenance procedures, a resilient cover is not required on the spur track portion. Latches 480 may be used to hold the slot cover switch in place.

Figures 13A, 13B:
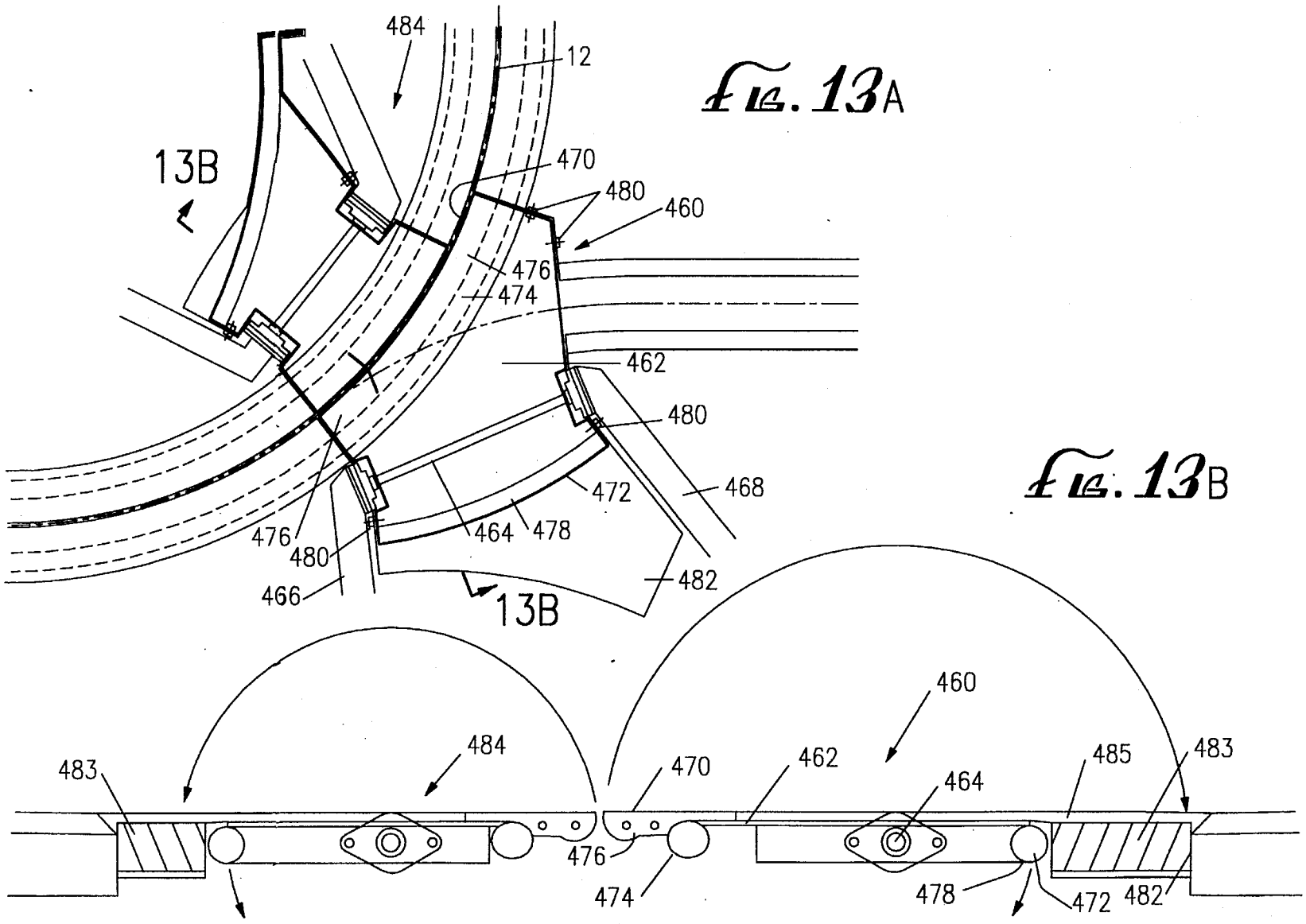
FIG. 13A is a plan view of a slot cover switch of the present invention shown in a main position.
FIG. 13B is a sectional view of the slot cover switch shown in FIG. 13A, taken along line 13B—13B.

The shape of the main track portion 470 is such that the slot cover follows the main portion of the ride course 12 when in a main track position (FIG. 13A). When the track is switched, however, to take the ride vehicle off the main portion of the ride course, the slot cover switch 460 may be unlatched and rotated (as shown in FIG. 13B) to a maintenance position (see FIG. 14B). It will be appreciated that the spur track portion 472 is shaped such that the tubular support 478 follows the maintenance spur 30 into the maintenance area. When the track is switched back to the ride course, the slot cover switch may be rotated in the opposite direction to return the main track portion to its original position (FIG. 13A). In the preferred embodiment, the show floor is provided with a recessed portion 482 for receiving the main track portion 470 when the slot cover switch is moved to the maintenance position (FIG. 14B). When the slot cover switch is in the main track position, a plug 483 of wood or other suitable material may be placed in the recessed portion and removable flooring 485 may be placed over the metal plate 462 to provide a level walking surface with the show floor (FIG. 13B).

Figure 16A:
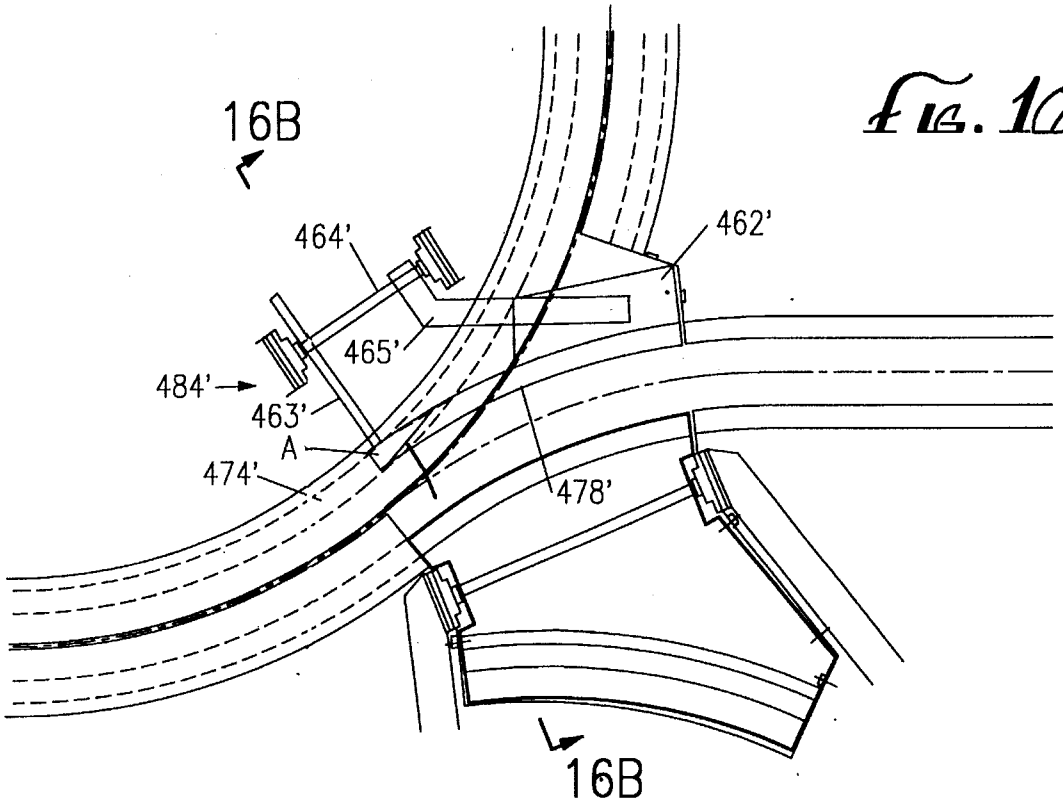
FIG. 16A is a plan view of the alternative slot cover switch shown in the maintenance position.
Figure 16B:
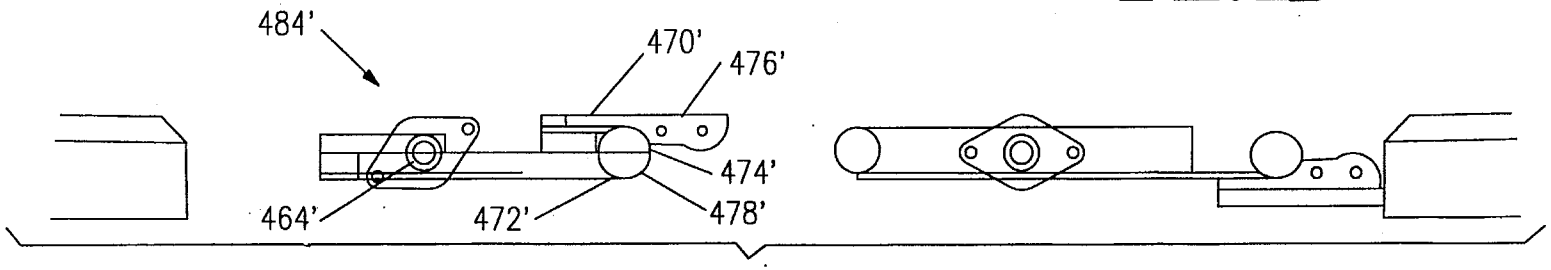
FIG. 16B is a sectional view of the slot cover switch shown in FIG. 16A, taken along line 16B—16B.

It will be appreciated that a second slot cover switch 484 is placed on the opposite side of the track from the slot cover switch 460. The second slot cover switch may operate in the same manner as described above. Alternatively, other structures may be employed. For example, with reference to FIGS. 15 and 16, a second slot cover switch 484' is shown having a metal support structure 462' with two arms 463', 465'. One end of each of the arms is mounted to a rotatable shaft 464'. The other end of each arm is fastened to a spur track portion 472', having a tubular support 478'. In this case, a main track portion 470', including a tubular support 474' and resilient cover 476' is permanently mounted to the show floor and remains in place when the second slot cover switch is rotated between its main track position (FIGS. 15A and B) and its maintenance position (FIGS. 16A and B). Accordingly, an advantage of this embodiment is that the resilient cover 476' on the inside curve of the main portion of the ride course may remain intact and pinned to the prior and succeeding resilient covers along the slot.

In the maintenance position, the tubular support 474' of the main track portion overlaps the tubular support 478' of the spur track portion for a short distance along the main track portion of the ride course. At this overlap, designated "A" in FIGS. 15A and 16A, the tubular supports 474', 478'for the main track portion and the spur track portion, respectively, are semi-circular in cross section and are placed in opposed, contacting relationship to each other (see FIG. 16B).

Figure 17:
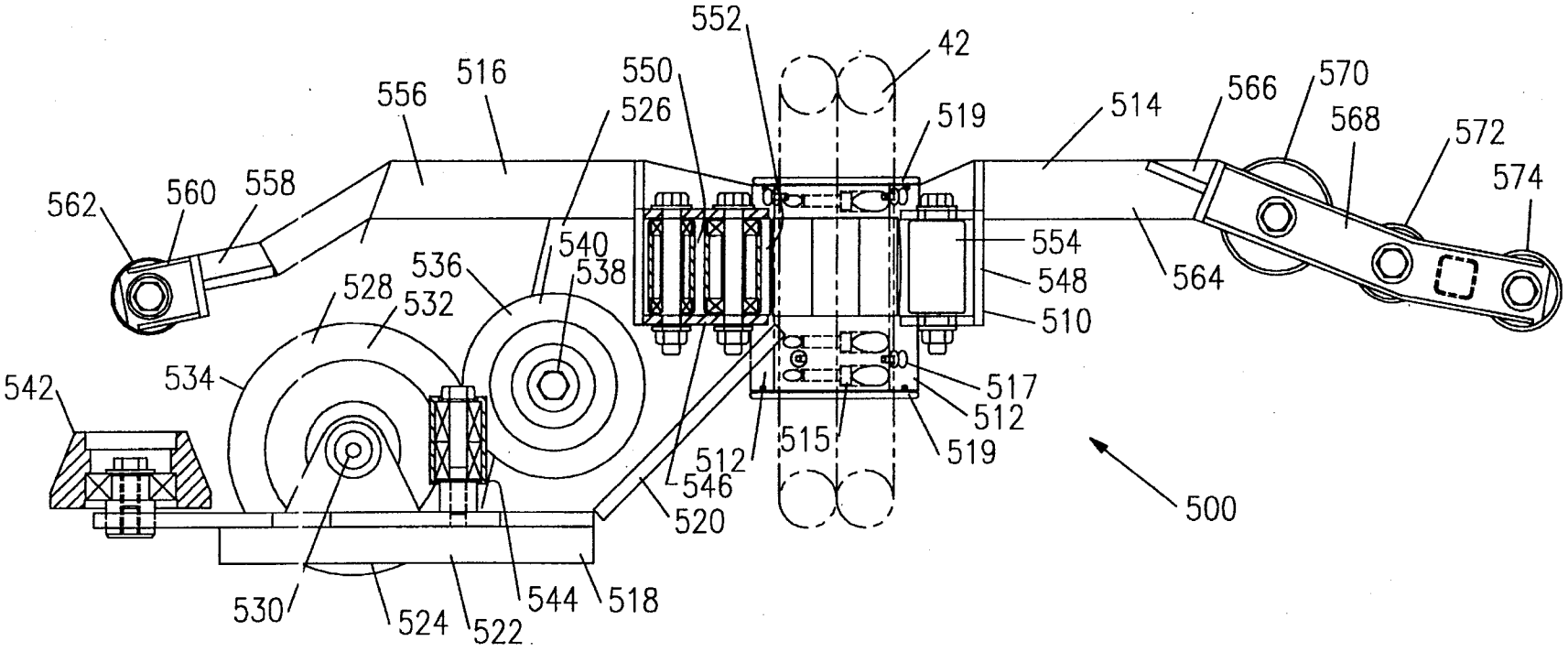
FIG. 17 an elevational view, partially in section, of a preferred plow assembly of the present invention.
Figure 18:
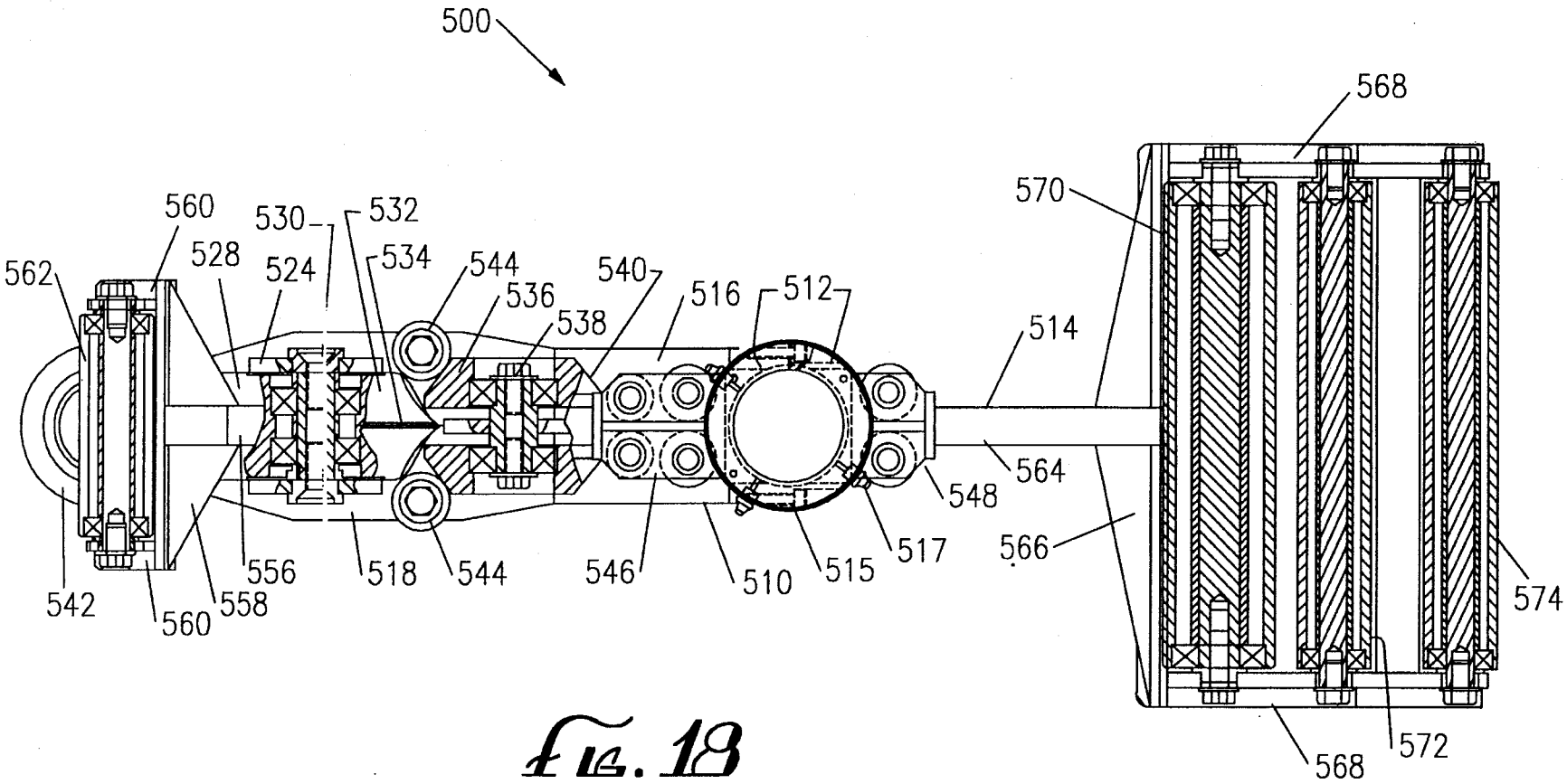
FIG. 18 a plan view of the plow assembly shown in FIG. 17.

With reference now to FIGS. 17–18, the preferred plow assembly 500 will be described in detail. The plow assembly includes a frame 510 having a split sleeve 512, a rearwardly extending roller support 514, a forwardly extending roller support 516 and a forwardly extending plow wheel support 518. The split sleeve houses a split journal bearing which is clamped around the support tube, e.g. by fasteners 515, to permit rotation of the plow assembly around the support tube. Grease fittings 517 permit lubrication of the bearing. Upper and lower clamping collars 519 locate the plow assembly vertically.

The forwardly extending plow wheel support 518 includes a downwardly extending bracket 520 and a horizontally extending bracket 522. The horizontally extending bracket includes an opening 524 therethrough. A vertical plate 526 extends lengthwise between the forwardly extending plow wheel support 518 and the forwardly extending roller support 516. A primary roller plow wheel 528 is rotatably mounted about a traversely disposed shaft 530 in the opening 524 of the forwardly extending plow wheel support. The primary roller plow wheel has an outer wedge surface 532 that forms an outer circumferential edge 534. During movement of the vehicle, the primary roller plow wheel is located such that the edge 534 will separate the opposed resilient covers of the slot cover and the wedge surface 532 will lift the covers out of the slot.

A secondary roller plow wheel 536 is located rearwardly and upwardly of the primary roller plow wheel 528 and is rotatably mounted about a traversely disposed shaft 538 to the vertical plate 526. The secondary roller plow wheel has an angled surface 540 that extends traversely beyond the width of the primary roller plow wheel such that the opposed resilient covers will be further separated and lifted as the support tube travels along and through the slot.

A front wheel guide 542 extends up from and is rotatably mounted to the front of the forwardly extending plow wheel support 518. The front wheel guide rotates about a vertical axis and is configured to contact the outer surfaces of the support brackets of the slot cover such that the primary roller plow wheel 528 will remain centered in the slot. Similarly, two side roller guides 544 are located rearwardly from the front wheel guide and are rotatably mounted to the forwardly extending plow wheel support. The side roller guides rotate about vertical axes and are configured to contact the steel tubular portion of each support bracket such that the secondary roller plow wheel 536 will remain centered in the slot.

Mounted to the sleeve are front and rear barrel roller brackets 546, 548. A first pair of barrel rollers 550 are mounted to the front end of the front barrel roller bracket, a second pair of barrel rollers 552 are mounted to the rear end of the front barrel roller bracket and a third pair or rollers 554 are mounted to the rear barrel roller bracket. The first, second and third pairs of barrel rollers are vertically oriented and are also sized and located relative to the support tube 42 to protect the support tube from undue damage caused by the resilient covers as the support tube travels along and through the slot. In the preferred embodiment, the first, second and third pairs of barrel rollers are symmetrically located on either side of the support tube. The first pair of barrel rollers have a smaller diameter than the second and third pairs of barrel rollers.

The forwardly extending roller support 516 includes a forwardly extending arm 556 that supports a U-shaped bracket 558. The bracket has a pair of spaced apart arms 560. A front pushdown roller 562 is rotatably mounted between the spaced apart arms.

The rearwardly extending roller support 514 includes a rearwardly extending arm 564 that supports a U-shaped bracket 566. The bracket has a pair of spaced apart arms 568. A rear pushdown roller 570 and a first and second pushdown barrel rollers 572, 574 are mounted between the spaced apart arms.

The forwardly extending roller support 516 and the rearwardly extending roller support 514 are located relative to the show floor and the slot cover such that the lower surface of the front pushdown roller 562 and the second pushdown barrel roller 574 are at substantially the same elevation as the top surface of the resilient covers. The front pushdown roller ensures that the covers are properly located in the slot prior to being raised out of the way by the roller plow wheels as the support shaft passes by. The rear pushdown rollers ensure that the covers are properly replaced in the slot after passage of the support tube. This prevents the "wheels" of the passenger car from bumping the raised covers. The rear pushdown rollers also serve to prevent the lap bar release assembly from being mistakenly engaged as the passenger car is spun while traveling along the ride course.

As the ride vehicle travels along and through the slot, the front wheel guide 542 and side roller guides 544 will locate the assembly in the slot to properly position the primary roller plow wheel 528 between the resilient covers. The front pushdown roller 562 will ensure that the resilient covers are not out of place just prior to contacting the primary roller plow wheel. The primary and secondary roller plow wheels will then gradually separate and lift the resilient covers and the first, second and third pairs of barrel rollers 550, 552, 554 will prevent the resilient covers from heavily impacting the support shaft 42. Finally, the rear pushdown roller 570 and the pushdown barrel rollers 572, 574 will replace the resilient covers in their proper location in the slot.

It will be appreciated from the foregoing description that the present invention describes an improved amusement ride and ride vehicle that permit the passenger to control the rotation of the passenger car as the vehicle travels along the ride course. The ride vehicle includes a support tube upon which the passenger car is rotatably mounted and a passenger operable steering mechanism. The ride vehicle also includes a spin shaft that extends down through and is mechanically isolated from the support tube. The spin shaft permits the use of braking and indexing systems that are mounted to the chassis of the ride vehicle. The indexing operation is controlled by simple relay logic. In particular, the control logic may be used to turn the passenger cars to a forward orientation at the end of the ride. The ride vehicle chassis is shaped to permit it to turn sharp corners along the ride course. The passenger car includes a readily adjustable lap bar that is self-releasing. As an added safety precaution, the present invention also includes a slot cover that is designed to be displaced by a plow assembly mounted to the support tube of the ride vehicle as the ride vehicle passes along and through the slot. A special slot cover switch is also provided that readily permits a ride vehicle to be switched from a main track portion of the ride course to a maintenance spur. The present invention provides an amusement ride and ride vehicle that are safe, yet significantly adds to the excitement of the ride experience because the passengers are permitted to control the direction and spin of their passenger car.

It will, of course, be understood that modifications to the present preferred embodiment will be apparent to those skilled in the art. Consequently, the scope of the present invention should not be limited by the particular embodiments discussed above, but should be defined only by the claims set forth below and equivalents thereof.

We claim:

1. An amusement ride vehicle for transporting passengers along a ride course, the amusement ride vehicle comprising:

a chassis;

a tubular support shaft having a lower end and an upper end, the lower end fixedly mounted to the chassis;

an upper frame, including a passenger car, the upper frame rotatably mounted to the upper end of the support shaft to permit spinning of the upper frame relative to the support shaft;

passenger operable steering means for controlling the speed and direction of spin of the upper frame; and a spin shaft fixedly mounted relative to the upper frame and extending downwardly through the inside of the support shaft.

2. The amusement ride vehicle of claim 1 further comprising a spin brake operably engaged to a lower end of the spin shaft for preventing rotation of the spin shaft.

3. The amusement ride vehicle of claim 2 further comprising a rotary speed switch for activating the spin brake when the rotational speed of the passenger car exceeds a predetermined level.

4. The amusement ride vehicle of claim 1, further comprising a slip ring fastened to a lower end of the spin shaft for collecting electrical power and means for transmitting the electrical power through the spin shaft to the passenger car.

5. The amusement ride vehicle of claim 1 further comprising, position detection means for determining whether the passenger car is facing in one of three directions, a first direction that is predetermined, a second direction that requires a clockwise rotation of the spin shaft to face the passenger car in the first direction in the shortest possible distance or a third direction that requires a counterclockwise rotation of the spin shaft to face the passenger car in the first direction in the shortest possible distance, control logic means for generating a first signal indicative of when the passenger car is facing the first direction, a second signal indicative of when the passenger car is facing the second direction, and a third signal indicative of when the passenger car is facing the third direction, and indexing means responsive to the signals generated by the control logic means for rotating the spin shaft, said indexing means being disabled in response to the first signal, rotating the spin shaft clockwise in response to the second signal and rotating the spin shaft counterclockwise in response to the third signal.

6.The amusement ride vehicle of claim 5 further comprising a fail-safe spin brake for preventing rotation of the spin shaft and a clutch for disengaging the indexing means during a selected portion of the ride course.

7. The amusement ride vehicle of claim 6, wherein the fail-safe brake stops the spin shaft from spinning during an emergency power failure.

8. An amusement ride for transporting passengers comprising:

a ride course;

a show floor mounted above the ride course, the show floor defining a continuous slot that corresponds to the path of the ride course;

a chassis disposed below the show floor and engaging the ride course to permit movement relative thereto;

a motor for propelling the chassis along the ride course;

a support shaft having a lower end and an upper end, the lower end fixedly mounted to the chassis such that the support shaft extends up through the slot in the show floor;

an upper frame, including a passenger car, rotatably supported by the support shaft at the upper end of the support shaft to permit spinning of the upper frame above the show floor; and passenger operable steering means for controlling the speed and direction of spin of the upper frame.

9. The amusement ride of claim 8, wherein the upper frame is rotatably mounted to the upper end of the support shaft by a turnable ring bearing, the turnable ring bearing having an inner race and an outer race that rotate relative to one another, one of said inner and outer race fixed to the upper end of the support shaft and the other of said inner and outer race fixed to the upper frame.

10. The amusement ride of claim 8, further comprising, a bearing support plate fixed to the upper end of the support shaft, and a turntable ring bearing having an inner race and an outer race that rotate relative to one another, the outer race fixed to the bearing support plate and the inner race fixed to the upper frame.

11. The amusement ride of claim 10 wherein the steering means includes a passenger operable steering wheel, a pinion pulley rotatably mounted to the upper frame, a belt operably engaging the pinion pulley and the outer race of the turntable ring bearing and a shaft between the steering wheel and the pinion pulley causing the pinion pulley to rotate upon rotation of the steering wheel.

12. The amusement ride of claim 8, wherein the steering means includes a passenger operable steering wheel, a pinion pulley rotatably mounted to the upper frame, a fixed pulley mounted to the upper end of the support shaft, a belt operably engaging the pinion pulley and the fixed pulley and a shaft between the steering wheel and the pinion pulley causing the pinion pulley to rotate upon rotation of the steering wheel.

13. The amusement ride of claim 12, wherein the shaft is a flexible shaft and the fixed pulley is concentrically mounted to the support shaft.

14. The amusement ride of claim 12 further comprising a slip clutch associated with the steering means for disabling the steering means when the torque applied to the steering wheel exceeds a predetermined limit.

15. The amusement ride of claim 12 further comprising two idler pulleys rotatably mounted to the upper frame and operably engaged to the belt such that the belt rotates in a direction opposite to the direction of rotation of the pinion pulley.

16. The amusement ride of claim 15 wherein the belt is a two-sided toothed belt and the pinion pulley and fixed pulley have teeth for engaging the respective sides of the toothed belt.

17. The amusement ride of claim 8 further comprising a slot cover having a plurality of resilient covers mounted to opposite sides of the slot for covering the slot and a plow mounted to the support shaft for lifting the covers out of the way as the support shaft travels through the slot.

18. The amusement ride of claim 17, wherein the ride course includes a main portion, a maintenance spur and a ride course switch for switching the ride course between the main portion and the maintenance spur, and further comprising a slot cover switch for switching the show floor between the main portion and the maintenance spur of the ride course, said slot cover switch rotatably moving a portion of the show floor at a location adjacent to the ride course switch between the main portion and the maintenance spur of the ride course.

19. The amusement ride of claim 8 further comprising a slot cover including, a first rigid support bracket mounted along one side of the slot having an outer surface that extends downwardly into the slot, a second rigid support bracket mounted along the other side of the slot having an outer surface that extends downwardly into the slot, the first and second support brackets being spaced apart from each other to permit the support shaft to pass therebetween, a first resilient cover having a proximal portion mounted on the first support bracket and a distal portion that extends into the slot from the outer surface of the first support bracket, a second resilient cover having a proximal portion mounted on the second support bracket and a distal portion that extends into the slot from the outer surface of the second support bracket, the first and second resilient covers being disposed in opposed relationship to each other at the center of the slot, and wherein the proximal portions of the resilient covers have bottom surfaces that match the configuration of the outer surfaces of the support brackets such that vertical loads on the resilient covers due to passenger egress are supported by the support brackets.

20. The amusement ride of claim 19 wherein the bottom surface of the first resilient cover defines a recess that acts as a hinge when an upward force is applied to the distal portion of the first resilient cover.

21. The amusement ride of claim 19 wherein the first and second support brackets each include a plate portion that is mounted along the side of the slot and a tube portion having said outer surface that faces into the slot, the tube portion being integrally connected to the plate portion.

22. The amusement ride of claim 19 further comprising a plurality of said slot covers extending along the slot.

23. The amusement ride of claim 22 wherein the first resilient cover of one of the plurality of slot covers is pinned to the first resilient cover of the next succeeding slot cover of the plurality of slot covers.

24. The amusement ride of claim 8 wherein the support shaft is tubular and wherein the amusement ride further comprises, a spin shaft fixably mounted to the upper frame and extending downwardly through the inside of the support shaft, location detection means for determining whether the passenger car is located on a first portion of the ride course or a second portion of the ride course, brake logic means for generating a first signal indicative of when the passenger car is located on the first portion of the ride course and a second signal indicative of when the passenger car is located on the second portion of the ride course, and a brake assembly responsive to the signals generated by the brake logic means, said brake assembly permitting rotation of the spin shaft in response to the first signal and preventing rotation of the spin shaft in response to the second signal.

25. The amusement ride of claim 24 wherein the location detection means includes off-board targets located along the ride course and on-board sensors to detect the off-board targets as the chassis travels along the ride course.

26. The amusement ride of claim 16, further comprising a lap bar assembly mounted to the passenger car, the lap bar assembly including a hydraulic actuator having a depressible pin valve, a lap bar mounted to the hydraulic cylinder and moveable between a raised position and a lowered position when the pin valve is depressed, and means for depressing the pin valve when the lap bar is pulled down and for releasing the pin valve when the lap bar is pushed up.

27. The amusement ride of claim 16, wherein the chassis has a barbell shape to permit the chassis to turn sharp corners.

28. An amusement ride comprising:

a ride course;

a show floor mounted above the ride course, the show floor defining a continuous slot that corresponds to the path of the ride course;

a chassis disposed below the show floor and engaging the ride course to permit movement relative thereto;

a motor for propelling the chassis along the ride course;

a support tube having a lower end and an upper end, the lower end fixably mounted to the chassis such that the support tube extends up through the slot in the show floor;

an upper frame, including a passenger car, rotatably mounted to the upper end of the support tube to permit spinning of the upper frame above the show floor; and a spin shaft fixedly mounted to the upper frame and extending downwardly below the lower end of the support tube.

29. The amusement ride of claim 28 further comprising, position detection means for determining whether the passenger car is facing in one of three directions, a first direction that is predetermined, a second direction that requires a clockwise rotation of the spin shaft to face the passenger car in the first direction in the shortest possible distance or a third direction that requires a counterclockwise rotation of the spin shaft to face the passenger car in the first direction in the shortest possible distance, control logic means for generating a first signal indicative of when the passenger car is facing the first direction, a second signal indicative of when the passenger car is facing the second direction, and a third signal indicative of when the passenger car is facing the third direction, and indexing means responsive to the signals generated by the control logic means for rotating the spin shaft, said indexing means being disabled in response to the first signal, rotating the spin shaft clockwise in response to the second signal and rotating the spin shaft counterclockwise in response to the third signal.

30. The amusement ride of claim 29, further comprising:

location detection means for determining whether the passenger car is located on a first portion of the ride course or a second portion of the ride course, said control logic means further generating a fourth signal indicative of when the passenger car is located on the first portion of the ride course and a fifth signal indicative of when the passenger car is located on the second portion of the ride course, and a brake assembly responsive to the fourth and fifth signals generated by the control logic means, said brake assembly permitting rotation of the spin shaft in response to the fourth signal and preventing rotation of the spin shaft in response to the fifth signal.

31. The amusement ride vehicle of claim 28 further comprising a spin brake operably engaged to a lower end of the spin shaft for preventing rotation of the spin shaft.

32. The amusement ride vehicle of claim 28 further comprising a rotary speed switch for activating the spin brake when the rotational speed of the passenger car exceeds a predetermined level.

33. The amusement ride vehicle of claim 28, further comprising a slip ring fastened to a lower end of the spin shaft for collecting electrical power and means for transmitting the electrical power through the spin shaft to the passenger car.

34. The amusement ride vehicle of claim 28 further comprising a fail-safe spin brake for preventing rotation of the spin shaft.

35. The amusement ride vehicle of claim 28 further comprising a clutch for disengaging the indexing means during a selected portion of the ride course.

36. An amusement ride comprising:

a ride course:

a chassis engaging the ride course to permit movement relative thereto;

a motor for propelling the chassis along the ride course;

an upper frame, including a passenger car, rotatably mounted to the chassis;

position detection means for determining whether the passenger car is facing in one of three directions, a first direction that is predetermined, a second direction that requires a clockwise rotation of the passenger car to face the passenger car in the first direction in the shortest possible distance or a third direction that requires a counterclockwise rotation of the passenger car to face the passenger car in the first direction in the shortest possible distance, control logic means for generating a first signal indicative of when the passenger car is facing the first direction, a second signal indicative of when the passenger car is facing the second direction, and a third signal indicative of when the passenger car is facing the third direction, and indexing means responsive to the signals generated by the control logic means for rotating the passenger car, said indexing means being disabled in response to the first signal, rotating the passenger car clockwise in response to the second signal and rotating the passenger car counterclockwise in response to the third signal.

37. The amusement ride of claim 36, further comprising:

location detection means for determining whether the passenger car is located on a first portion of the ride course or a second portion of the ride course, said control logic means further generating a fourth signal indicative of when the passenger car is located on the first portion of the ride course and a fifth signal indicative of when the passenger car is located on the second portion of the ride course, and a brake assembly responsive to the fourth and fifth signals generated by the control logic means, said brake assembly permitting rotation of the passenger car in response to the fourth signal and preventing rotation of the passenger car in response to the fifth signal.

38. The amusement ride of claim 36, wherein the position detection means includes:

a spin shaft fixed relative to the passenger car;

a nonmetallic disk concentrically mounted to the spin shaft;

a metallic rim covering a portion of the outer periphery of the disk; and two index detection sensors directed toward and in close proximity to the outer periphery of the disk for detecting the metallic rim.

39. The amusement ride of claim 38, wherein the metallic rim is semicircular and wherein the sensors are separated by an arc of approximately 140 degrees.

40. The amusement ride of claim 36, wherein the indexing means includes:

a spin shaft fixed relative to the passenger car;

an indexing sprocket fixed relative to the spin shaft; and means engaging the indexing sprocket for rotating the spin shaft.

41. The amusement ride of claim 36, further comprising an indexing sensor means for determining whether the passenger car is located in an indexing portion of the ride course and wherein said control logic means generates an indexing signal upon triggering of the indexing sensor means to initiate an indexing operation to face the passenger car in the first direction.

42. An amusement ride comprising:

a ride course;

a show floor mounted above the ride course, the show floor defining a continuous slot that corresponds to the path of the ride course;

a chassis disposed below the show floor and engaging the ride course to permit movement relative thereto;

a motor for propelling the chassis along the ride course;

a support shaft having a lower end and an upper end, the lower end fixedly mounted to the chassis such that the support shaft extends up through the slot in the show floor;

an upper frame, including a passenger car, mounted to the upper end of the support shaft above the floor; and a slot cover including first and second support brackets and first and second resilient covers;

the first rigid support bracket mounted along one side of the slot having an outer surface that extends downwardly into the slot;

the second rigid support bracket mounted along the other side of the slot having an outer surface that extends downwardly into the slot, the first and second support brackets being spaced apart from each other to permit the support shaft to pass therebetween;

the first resilient cover having a proximal portion mounted on the first support bracket and a distal portion that extends into the slot from the outer surface of the first support bracket;

the second resilient cover having a proximal portion mounted on the second support bracket and a distal portion that extends into the slot from the outer surface of the second support bracket, the first and second resilient covers being disposed in opposed relationship to each other at the center of the slot;

wherein the proximal portions of the resilient covers have bottom surfaces that match the configuration of the outer surfaces of the support brackets such that the support brackets support vertical loads applied to the resilient covers due to passenger egress.

43. The amusement ride of claim 42 wherein the ride course includes a main portion, a maintenance spur and a ride course switch for switching the ride course between the main portion and the maintenance spur, and further comprising a slot cover switch for switching the show floor between the main portion and the maintenance spur of the ride course, said slot cover switch rotatably moving a portion of the show floor at a location adjacent to the ride course switch between the main portion and the maintenance spur of the ride course.

44. The amusement ride of claim 42 wherein the bottom surface of the first resilient cover defines a recess that acts as a hinge when an upward force is applied to the distal portion of the first resilient cover.

45. The amusement ride of claim 42 wherein the first and second support brackets each include a plate portion that is mounted along the side of the slot and a tube portion having said outer surface that faces into the slot, the tube portion being integrally connected to the plate portion.

46. The amusement ride of claim 42 further comprising a plurality of said slot covers extending along the slot.

47. The amusement ride of claim 44 wherein the first resilient cover of one of the plurality of slot covers is pinned to the first resilient cover of the next succeeding slot cover of the plurality of slot covers.

48. The amusement ride of claim 47 wherein said plow includes a roller plow wheel having an outer wedge surface that separates and lifts the resilient covers out of the slot as the support shaft travels through the slot.

49. The amusement ride of claim 47 wherein said plow further includes a front wheel guide that is configured to contract the support brackets such that the roller plow wheel will remain centered in the slot as the support shaft travels through the slot.

50. The amusement ride of claim 47 wherein said plow further includes a forwardly extending roller support having a front pushdown roller mounted in front of the roller plow wheel, the front pushdown roller disposed relative to the slot cover such that the front pushdown roller pushes the resilient covers down to the same elevation as the show floor.

51. The amusement ride of claim 42, further comprising a plow rotatably mounted to the support shaft for lifting the covers out of the way as the support shaft travels through the slot.

52. The amusement ride of claim 51, wherein said plow further includes a rearwardly extending roller support having a rear pushdown roller means disposed relative to the slot cover for pushing the resilient covers down to the same elevation as the show floor.

53. The amusement ride of claim 51, wherein said plow further includes means for protecting the support shaft from slot cover impact including vertically oriented pairs of barrel rollers.

54. An amusement ride comprising:

a ride course;

a floor laid out along the ride course;

a passenger car disposed above the floor and engaging the ride course to permit movement relative thereto;

a motor for propelling the passenger car along the ride course; and a lap bar assembly mounted to the passenger car, the lap bar assembly including a hydraulic actuator having a depressible pin valve, a lap bar mounted to the hydraulic cylinder and moveable between a raised position and a lowered position when the pin valve is depressed, and means for depressing the pin valve when the lap bar is pulled down and for releasing the pin valve when the lap bar is pushed up.

55. The amusement ride of claim 54 further comprising a lap bar release assembly means, including a rotatable release arm, for depressing the pin valve, wherein the release arm extends downwardly toward the floor and is actuable by a raised portion of the floor as the passenger car travels along the ride course.

56. An amusement ride comprising:

a ride course;

a show floor mounted above the ride course, the show floor defining a continuous slot that corresponds to the path of the ride course;

a chassis disposed below the show floor and engaging the ride course to permit movement relative thereto;

a motor for propelling the chassis along the ride course;

a support tube having a lower end and an upper end, the lower end fixably mounted to the chassis such that the support tube extends up through the slot in the show floor;

an upper frame, including a passenger car, rotatably mounted to the upper end of the support tube to permit spinning of the upper frame above the show floor;

a spin shaft fixedly mounted relative to the upper frame and extending downwardly through the inside of the support tube; and passenger operable steering means for controlling the speed and direction of spin of the upper frame.

* * * * *